US011825933B2

(12) United States Patent
Heman-Ackah et al.

(10) Patent No.: US 11,825,933 B2
(45) Date of Patent: Nov. 28, 2023

(54) LIQUID-PERMEABLE BRUSH ROLL FOR USE WITH CLEANERS INCLUDING ROBOTIC CLEANERS

(71) Applicant: SHARKNINJA OPERATING LLC, Needham, MA (US)

(72) Inventors: Marian Heman-Ackah, Needham, MA (US); Douglas Petro, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 260 days.

(21) Appl. No.: 17/144,389

(22) Filed: Jan. 8, 2021

(65) Prior Publication Data

US 2021/0204684 A1 Jul. 8, 2021

Related U.S. Application Data

(60) Provisional application No. 62/958,403, filed on Jan. 8, 2020.

(51) Int. Cl.

| | |
|---|---|
| ***A46B 11/00*** | (2006.01) |
| ***A46B 13/00*** | (2006.01) |
| ***A46B 13/04*** | (2006.01) |
| ***A47L 11/282*** | (2006.01) |
| ***A47L 11/40*** | (2006.01) |
| ***A47L 9/04*** | (2006.01) |

(52) U.S. Cl.

CPC ..... *A46B 11/0013* (2013.01); *A46B 11/0062* (2013.01); *A46B 13/001* (2013.01); *A46B 13/04* (2013.01); *A47L 9/0477* (2013.01); *A47L 11/282* (2013.01); *A47L 11/4041* (2013.01); *A47L 11/4083* (2013.01); *A46B 2200/3033* (2013.01); *A47L 2201/04* (2013.01)

(58) Field of Classification Search

CPC ..... A46B 11/0013; A46B 11/0062; A46B 11/0093; A46B 13/001; A46B 13/04; A46B 2200/3033; A47L 9/0477; A47L 11/18; A47L 11/185; A47L 11/282; A47L 11/302; A47L 11/408; A47L 11/4041; A47L 11/4083; A47L 2201/00; A47L 2201/04; A47L 11/401; A47L 11/40

USPC ..... 401/197; 492/40, 41

See application file for complete search history.

(56) References Cited

U.S. PATENT DOCUMENTS

| | | | | |
|---|---|---|---|---|
| 6,524,173 | B1 | 2/2003 | Nelson et al. | |
| 6,543,084 | B2 | 4/2003 | Dickey et al. | |
| 6,588,050 | B1 | 7/2003 | Aiken | |
| 6,804,856 | B2 | 10/2004 | Udall | |
| 7,849,556 | B1 | 12/2010 | Jansen | |
| 8,020,237 | B2 | 9/2011 | Boatman | |
| 8,087,121 | B1 * | 1/2012 | Michelson | A47L 13/14 15/228 |
| 8,458,853 | B2 | 6/2013 | Charlton et al. | |

(Continued)

*Primary Examiner* — Brian D Keller
*Assistant Examiner* — Sukwoo James Chang
(74) *Attorney, Agent, or Firm* — Grossman Tucker Perreault Pfleger, PLLC

(57) ABSTRACT

A liquid-permeable brush roll may include a main body having a radial surface, a cavity having an open end, a stopper removably coupled to the main body at the open end of the cavity, and one or more weep holes defined in the radial surface of the main body and fluidly coupled to the cavity. The cavity extends within the main body and is configured to store a cleaning fluid therein.

16 Claims, 14 Drawing Sheets

(56) References Cited

U.S. PATENT DOCUMENTS

| | | | | |
|---|---|---|---|---|
| 8,555,446 | B2 | 10/2013 | Moes et al. | |
| 9,173,536 | B2 | 11/2015 | Van Der Kooi et al. | |
| 9,186,032 | B2 | 11/2015 | De Wit et al. | |
| 9,615,710 | B2 * | 4/2017 | Babenhauserheide | A47L 11/4083 |
| 10,022,032 | B1 * | 7/2018 | Li | A47L 11/4022 |
| 10,349,796 | B2 | 7/2019 | De Wit et al. | |
| 10,441,129 | B2 | 10/2019 | Pfeiffer et al. | |
| 10,524,631 | B2 * | 1/2020 | Pfeiffer | A47L 11/14 |
| 10,758,102 | B2 | 9/2020 | Lindenbeck | |
| 10,856,715 | B2 | 12/2020 | Van Der Kooi et al. | |
| 10,905,302 | B2 | 2/2021 | Moon et al. | |
| 2011/0219555 | A1 | 9/2011 | Field et al. | |
| 2014/0215749 | A1 | 8/2014 | Van Der Kooi et al. | |
| 2018/0184870 | A1 * | 7/2018 | Moon | A47L 11/19 |
| 2018/0242810 | A1 | 8/2018 | Jang et al. | |
| 2018/0338656 | A1 * | 11/2018 | Carter | A47L 9/0488 |
| 2019/0274511 | A1 | 9/2019 | Du et al. | |

* cited by examiner

LIQUID-PERMEABLE BRUSH ROLL FOR USE WITH CLEANERS INCLUDING ROBOTIC CLEANERS

CROSS-REFERENCE TO RELATED APPLICATIONS

The present application claims the benefit of U.S. Provisional Application Ser. No. 62/958,403, filed on Jan. 8, 2020, entitled Robotic Cleaner with Liquid Permeable Brush Roll, which is fully incorporated herein by reference.

TECHNICAL FIELD

The present disclosure is generally directed to cleaning devices and more specifically directed to a cleaning device configured to carry out a wet cleaning operation.

BACKGROUND

The following is not an admission that anything discussed below is part of the prior art or part of the common general knowledge of a person skilled in the art.

A surface cleaning apparatus may be used to clean a variety of surfaces. Some surface cleaning apparatuses include a rotating agitator (e.g., brush roll). One example of a surface cleaning apparatus includes a vacuum cleaner which may include a rotating agitator as well as a vacuum source. Vacuum cleaners may include, for example, upright vacuum cleaners, canister vacuum cleaners, stick vacuum cleaners, central vacuum systems, and robotic vacuum cleaners. In some instances, vacuum cleaners may further include a wet cleaning mode. For example, a robotic cleaner may be configured to be a wet/dry robotic cleaner. Additional cleaners may include sweepers, mops, and other non-vacuum cleaners. For example, non-vacuum cleaners may include a robotic mop, a robotic sweeper, a powered broom, and/or any other cleaner that does not use a vacuum source.

Non-autonomous wet floor cleaning may include use of a mop. A mop may include a handle having a gripping end and a cleaning end. A cleaning implement (e.g., a sponge or bundle of absorbent materials such as string) may be coupled to the cleaning end. The mop can be configured to be used to apply a cleaning fluid onto a surface (e.g., a floor). For example, the cleaning implement can be inserted into a cleaning fluid such that the cleaning implement can absorb cleaning fluid and an at least partially saturated cleaning implement can be moved across the surface to deposit cleaning fluid on the surface. Movement of the cleaning implement on the surface may agitate the surface (e.g., dislodge contaminants adhered thereto). The components of the cleaning fluid and the agitation may help suspend any contaminants on the surface into the cleaning fluid. The contaminants are then removed from the surface of the floor by using the mop to remove the cleaning fluid, generally by having the cleaning implement re-absorb the cleaning fluid, and thus the contaminants may become adhered to the cleaning implement. Water may be used to perform wet cleaning on floors, but it may be more effective to use a cleaning fluid that is a mixture of water and soap or detergent that reacts with contaminants to suspend the contaminants into the water. A cleaning fluid may further include other components such as a solvent, a fragrance, a disinfectant, a drying agent, abrasive particulates and the like to increase the effectiveness of the cleaning process and/or improve the end-results such as floor appearance.

BRIEF SUMMARY

An example of a liquid-permeable brush roll, consistent with the present disclosure, may include a main body having a radial surface, a cavity having an open end, a stopper removably coupled to the main body at the open end of the cavity, and one or more weep holes defined in the radial surface of the main body and fluidly coupled to the cavity. The cavity extends within the main body and is configured to store a cleaning fluid therein.

In some instances, the liquid-permeable brush roll may include an outer sheath configured to slidably engage the radial surface of the main body. In some instances, the outer sheath may be removably coupled to the main body. In some instances, the outer sheath may include an absorbent material. In some instances, the stopper may include an attachment mechanism configured to engage with a drive mechanism that is configured to cause the liquid-permeable brush roll to rotate.

An example of a cleaner, consistent with the present disclosure, may include a chassis and a liquid-permeable brush roll rotatable relative to the chassis. The liquid-permeable brush roll may include a main body having a radial surface, a cavity having an open end, a stopper removably coupled to the main body at the open end of the cavity, and one or more weep holes defined in the radial surface of the main body and fluidly coupled to the cavity. The cavity may extend within the main body and may be configured to store a cleaning fluid therein.

In some instances, the liquid-permeable brush roll may be removably coupled to the chassis. In some instances, the cleaner may further include a dry cleaning agitator. In some instances, one or more of the liquid-permeable brush roll or the dry cleaning agitator may be configured to float relative to the chassis. In some instances, the liquid-permeable brush roll may further include an outer sheath configured to slidably engage the radial surface of the main body. In some instances, the outer sheath may be removably coupled to the main body. In some instances, the outer sheath may include an absorbent material. In some instances, the cleaner may further include a drive mechanism configured to cause the liquid-permeable brush roll to rotate. In some instances, the stopper may include an attachment mechanism configured to engage with the drive mechanism.

An example of a robotic cleaner, consistent with the present disclosure, may include a chassis, a plurality of drive wheels configured to be independently driven, one or more sensors, and a liquid-permeable brush roll rotatable relative to the chassis. The liquid-permeable brush roll may include a main body having a radial surface, a cavity having an open end, a stopper removably coupled to the main body at the open end of the cavity, and one or more weep holes defined in the radial surface of the main body and fluidly coupled to the cavity. The cavity may extend within the main body and may be configured to store a cleaning fluid therein.

In some instances, the liquid-permeable brush roll may be removably coupled to the chassis. In some instances, the robotic cleaner may further include a dry cleaning agitator. In some instances, one or more of the liquid-permeable brush roll or the dry cleaning agitator may be configured to float relative to the chassis. In some instances, the liquid-permeable brush roll may further include an outer sheath configured to slidably engage the radial surface of the main body, wherein the outer sheath may include an absorbent material and may be removably coupled to the main body. In some instances, the robotic cleaner may further include a drive mechanism configured to cause the liquid-permeable brush roll to rotate, wherein the stopper may include an attachment mechanism configured to engage with the drive mechanism.

BRIEF DESCRIPTION OF THE DRAWINGS

These and other features and advantages will be better understood by reading the following detailed description, taken together with the drawings wherein.

DETAILED DESCRIPTION

The present disclosure is generally directed to a liquid-permeable brush roll for a cleaner (e.g., a robotic cleaner). The liquid-permeable brush roll includes a main body, a cavity having an open end that extends within the main body, a stopper removably coupled to the main body at the open end, and one or more weep holes defined in the main body. The one or more weep holes are fluidly coupled to the cavity. In some instances, the liquid-permeable brush roll may be removably coupled to the cleaner (e.g., a robotic cleaner). When removed from the cleaner, the stopper can be removed from the main body, exposing the open end of the cavity. When the stopper is removed from the main body, a cleaning fluid can be poured into the cavity extending within the main body.

As used herein, the terms "above" and "below" are used relative to an orientation of the cleaning apparatus on a surface to be cleaned and the terms "front" and "back" are used relative to a direction that the cleaning apparatus moves on a surface being cleaned during normal cleaning operations (i.e., back to front). As used herein, the term "leading" refers to a position in front of at least another component but does not necessarily mean in front of all other components.

Figure 1:
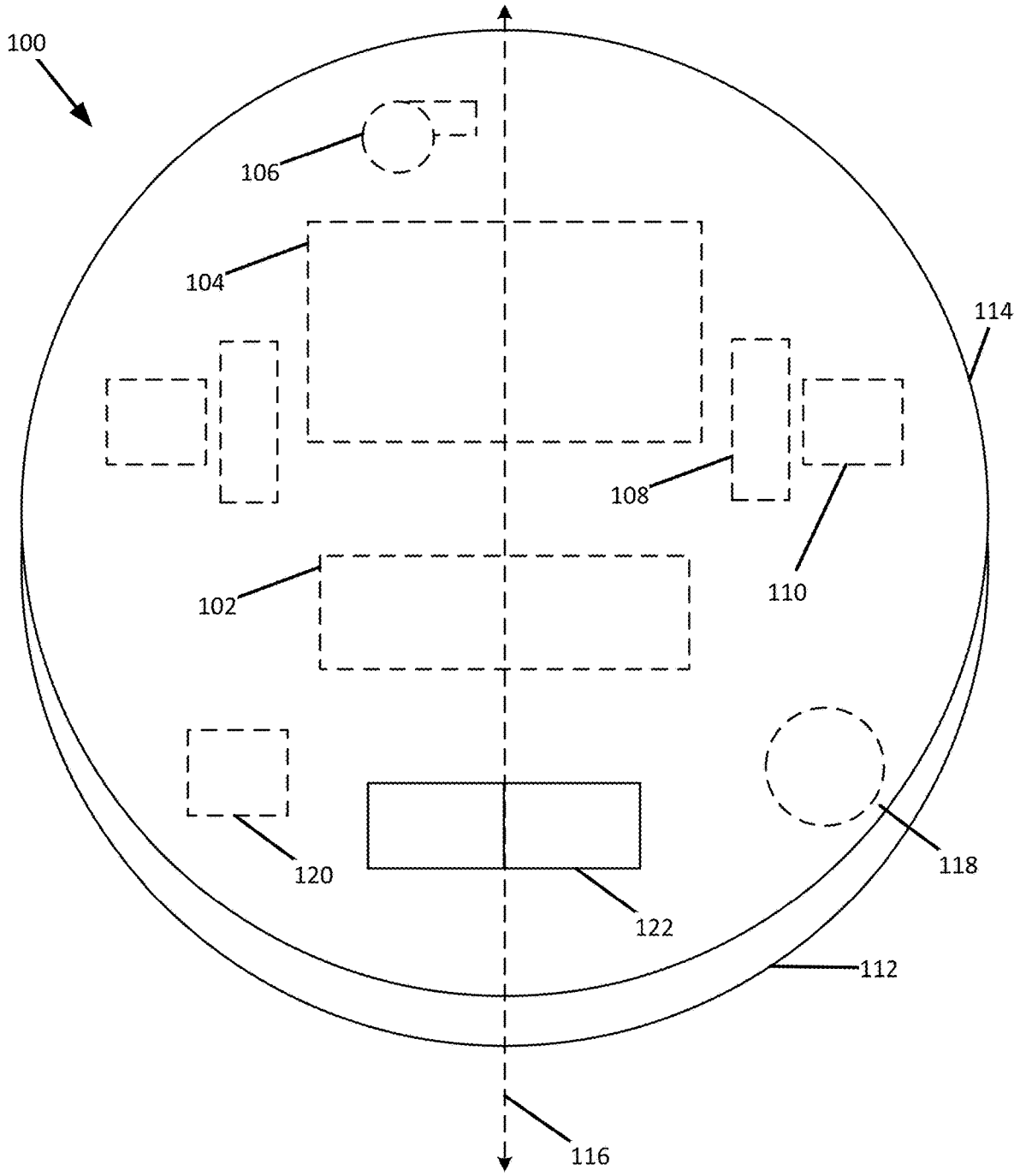
FIG. 1 is a schematic view of an example of a robotic cleaner, consistent with embodiments of the present disclosure.

FIG. 1 shows a schematic view of an example of a robotic cleaner 100 (e.g., a robotic vacuum cleaner). As shown, the robotic cleaner 100 includes an air inlet 102 fluidly coupled to a dust cup 104 and a suction motor 106. The suction motor 106 causes debris to be suctioned into the air inlet 102 and deposited into the dust cup 104 for later disposal.

As also shown, the robotic cleaner 100 includes a plurality of wheels 108 coupled to a respective drive motor 110. As such, each wheel 108 may generally be described as being independently driven. The robotic cleaner 100 can be steered by adjusting the rotational speed of one of the plurality of wheels 108 relative to the other of the plurality of wheels 108.

A displaceable bumper 112 can be disposed along a portion of a perimeter defined by a housing 114 of the robotic cleaner 100. The displaceable bumper 112 is configured to transition between an unactuated position and an actuated position in response to engaging, for example, an obstacle. The displaceable bumper 112 can be configured to be moveable along a first axis 116 extending generally parallel to a top surface of the housing 114. As such, the displaceable bumper 112 is displaced in response to engaging (e.g., contacting) at least a portion of an obstacle disposed on and extending from a surface to be cleaned (e.g., a forward obstacle). Additionally, or alternatively, the displaceable bumper 112 can be configured to be moveable along a second axis that extends transverse to (e.g., perpendicular to) the first axis 116. As such, the displaceable bumper 112 is displaced in response to engaging (e.g., contacting) at least a portion of an obstacle that is spaced apart from the surface to be cleaned (e.g., an overhanging obstacle). Therefore, the robotic cleaner 100 may avoid becoming trapped between the obstacle and the surface to be cleaned. The robotic cleaner 100 can be configured to determine along which axis the displaceable bumper 112 is displaced. Such a configuration may allow the robotic cleaner 100 to carry out different obstacle detection behaviors based, at least in part, on the location of the obstacle relative to the robotic cleaner 100. As such, the robotic cleaner 100 can have different behaviors based on whether the detected obstacle is an overhanging obstacle or a forward obstacle.

One or more side brushes 118 can be positioned such that a portion of the side brush 118 extends to the perimeter defined by the housing 114 of the robotic cleaner 100. The side brush 118 can be configured to urge debris in a direction of the air inlet 102 such that debris located outside of a path over which the air inlet 102 passes can be collected. For example, the side brush 118 can be configured to rotate in response to activation of a side brush motor 120. In some instances, the one or more side brushes 118 may not extend beyond the perimeter defined by the housing 114.

A user interface 122 can be provided to allow a user to control the robotic cleaner 100. For example, the user interface 122 may include one or more push buttons that correspond to one or more features of the robotic cleaner 100. Liquid ingress protection may be provided at the user interface 122 to prevent or otherwise mitigate the effects of a liquid being inadvertently spilled on the housing 114 of the robotic cleaner 100.

Figure 2A:
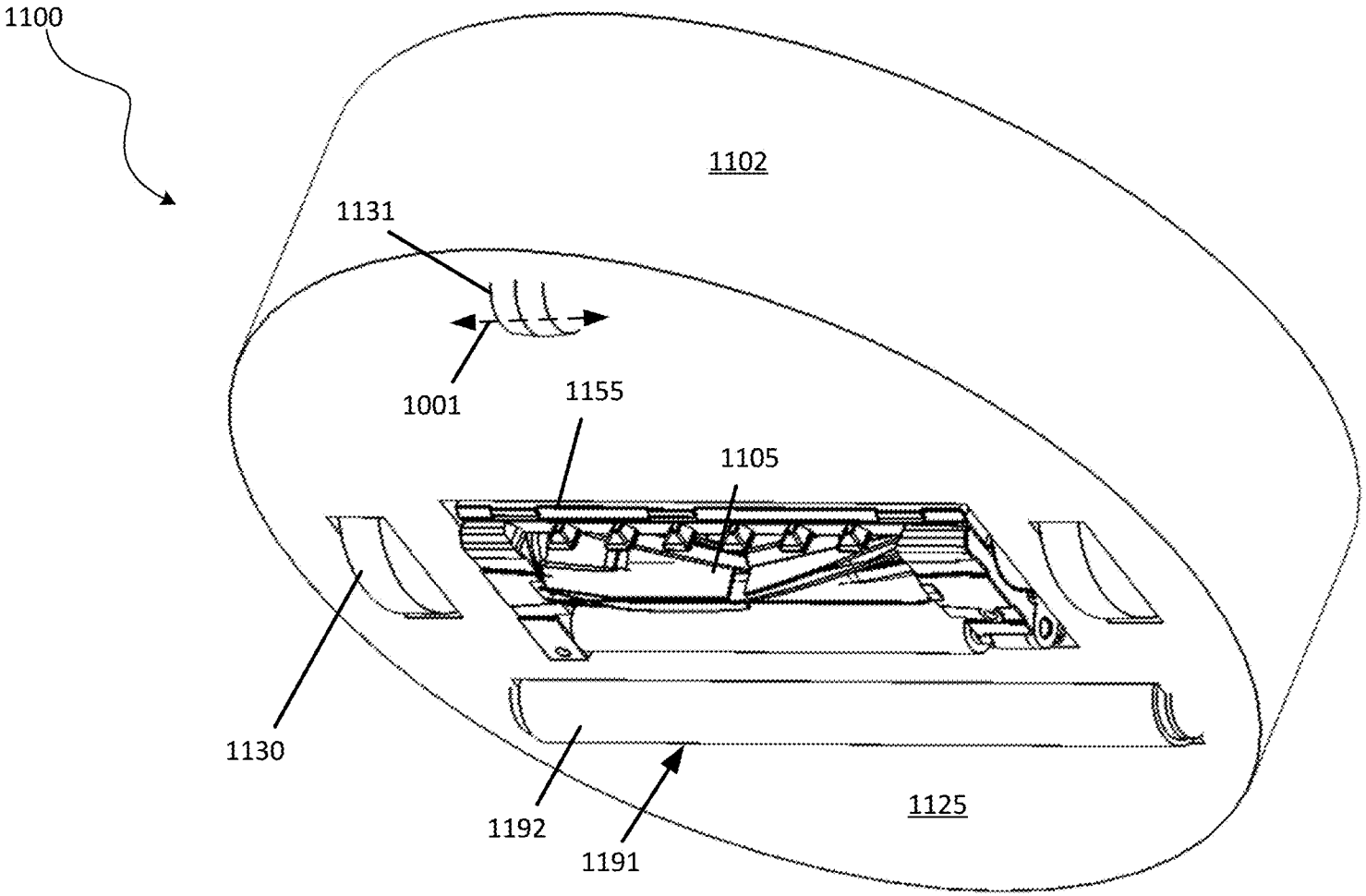
FIG. 2A is a schematic perspective view of a robotic cleaner, consistent with embodiments of the present disclosure.
Figure 2B:
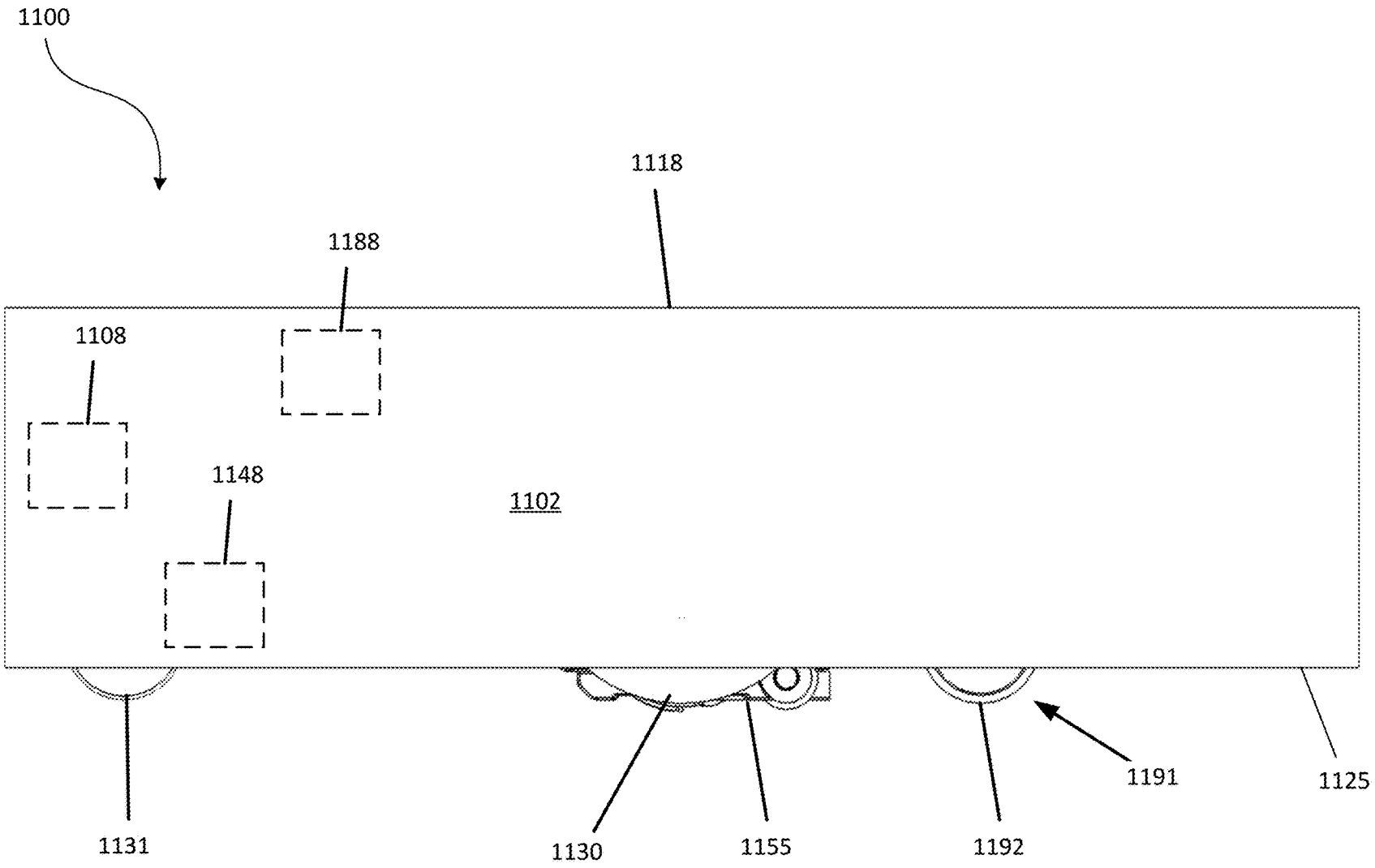
FIG. 2B is a schematic side view of the robotic cleaner of FIG. 2A, consistent with embodiments of the present disclosure.
Figure 2C:
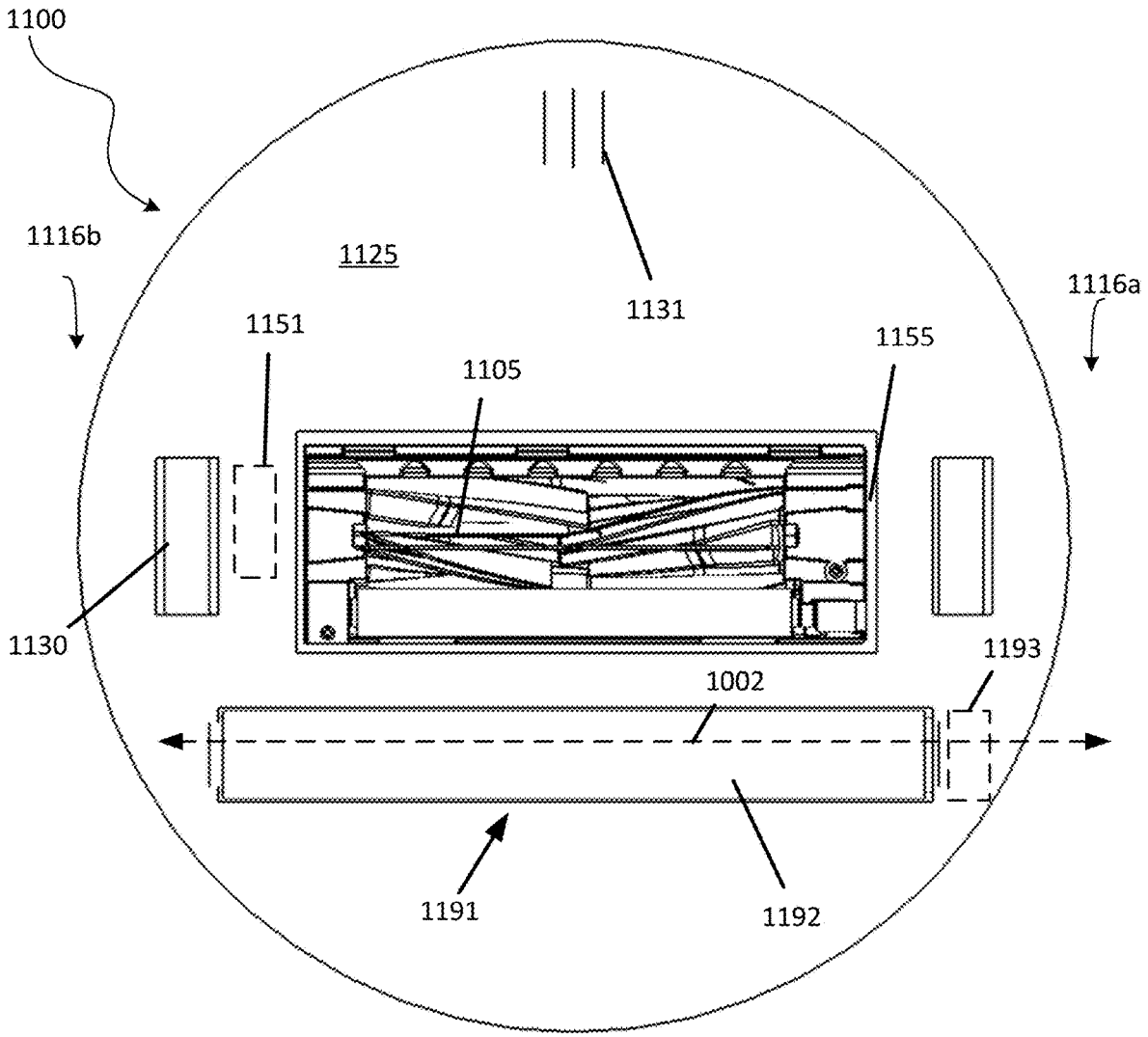
FIG. 2C is a schematic bottom view of the robotic cleaner of FIG. 2A, consistent with embodiments of the present disclosure.

Referring to FIGS. 2A-2C an embodiment of a robotic cleaner 1100, consistent with embodiments of the present disclosure, is shown and described. The robotic cleaner 1100 may be an example of the robotic cleaner 100. Although a particular embodiment of a robotic cleaner is shown and described herein, the concepts of the present disclosure may apply to other types of robotic vacuum cleaners or robotic cleaners. The robotic cleaner 1100 includes a housing or chassis 1102 with a front side, and a back side, left and right sides 1116*a*, 1116*b*, an upper side (or top surface) 1118, and a lower or under side (or bottom surface) 1125. A bumper (not shown) is movably coupled to the housing 1102 around a substantial portion of the forward portion of the housing 1102. The top of the housing 1102 may include controls (or a user interface) (e.g., buttons) to initiate certain operations, such as autonomous cleaning, spot cleaning, and docking and indicators (e.g., LEDs) to indicate operations, battery charge levels, errors and other information.

As shown, the robotic cleaner 1100 includes a suction conduit 1155 fluidly coupled to a dust cup and a suction motor. The suction motor causes debris to be suctioned into the suction conduit 1155 and deposited into the dust cup for later disposal.

As also shown, the robotic cleaner 1100 includes a plurality of wheels 1130 coupled to a respective drive motor contained within a driven wheel assembly. As such, each wheel 1130 may generally be described as being independently driven. The robotic cleaner 1100 can be steered by adjusting the rotational speed of one of the plurality of wheels 1130 relative to the other of the plurality of wheels 1130. The robotic cleaner 1100 may further include a plurality of non-driven wheels 1131 positioned fore and/or aft of the suction conduit 1155. The non-driven wheels 1131 may be caster wheels positioned to support the weight of the robotic cleaner 1100.

The caster wheel 1131 may be further used to control the engagement of a wet cleaning member 1191 with the surface to be cleaned. The wet cleaning member 1191 may include, for example, a liquid-permeable brush roll 1192, a cleaning fluid reservoir (e.g., disposed within the liquid-permeable brush roll 1192), and/or a wet cleaning pad. In some instances, the caster wheel 1131 may be shifted along a vertical axis such that a position of the liquid-permeable brush roll 1192 relative to a surface to be cleaned varies (e.g., the liquid-permeable brush roll 1192 moves towards or away from the surface to be cleaned). As a rotation axis 1001 of the caster wheel 1131 moves away from the top surface 1118 of the housing 1102, an engagement of the liquid-permeable brush roll 1192 with the floor increases (which may increase the cleaning effectiveness). However, increased engagement with the surface to be cleaned may increase frictional forces generated between the liquid-permeable brush roll 1192 and the surface to be cleaned. The increased friction may decrease a movement speed of the robotic cleaner 1100 along the surface to be cleaned. Therefore, a separation distance between the rotation axis 1001 of the caster wheel 1131 and the top surface 1118 can be adjusted, which may allow for the optimization of frictional forces with cleaning effectiveness and maneuverability of the robotic cleaner 1100. The caster wheel 1131 also improves the ability of the robotic cleaner to cross over thresholds while cleaning.

A displaceable bumper can be disposed along a portion of a perimeter defined by a housing 1102 of the robotic cleaner 1100. The displaceable bumper is configured to transition between an unactuated position and an actuated position in response to engaging, for example, an obstacle. The displaceable bumper can be configured to be moveable along a first axis extending generally/substantially (e.g., within 1°, 2°, 3°, 4°, or 5° of) parallel to a top surface of the housing 1102. As such, the displaceable bumper is displaced in response to engaging (e.g., contacting) at least a portion of an obstacle disposed on and extending from a surface to be cleaned. Additionally, or alternatively, the displaceable bumper can be configured to be moveable along a second axis that extends transverse to (e.g., perpendicular to) the first axis. As such, the displaceable bumper is displaced in response to engaging (e.g., contacting) at least a portion of an obstacle that is spaced apart from the surface to be cleaned. Therefore, the robotic cleaner 1100 may avoid becoming trapped between the obstacle and the surface to be cleaned.

A user interface (not shown) can be provided to allow a user to control the robotic cleaner 1100. For example, the user interface may include one or more push buttons that correspond to one or more features of the robotic cleaner 1100. Liquid ingress protection may be provided at the user interface to prevent or otherwise mitigate the effects of a liquid being inadvertently spilled on the housing 1102 of the robotic cleaner 1100.

The robotic cleaner 1100 includes a rotating agitator 1105 (e.g., a main brush roll). The rotating agitator 1105 rotates about a substantially horizontal axis to direct debris into the suction conduit 1155. The rotating agitator 1105 is at least partially disposed within the suction conduit 1155. The rotating agitator 1105 may be coupled to a motor 1151, such as an AC or DC electrical motor, to impart rotation, for example, by way of one or more drive belts, gears or other driving mechanisms. The robotic cleaner may also include one or more driven rotating side brushes (not shown) coupled to one or more side brush motors to sweep debris toward the rotating agitator 1105.

The rotating agitator 1105 may have bristles, fabric, or other cleaning elements, or any combination thereof around the outside of the agitator 1105. The rotating agitator 1105 may include, for example, strips of bristles in combination with strips of a rubber or elastomer material. The rotating agitator 1105 may also be removable to allow the rotating agitator 1105 to be cleaned more easily and allow the user to change the size of the rotating agitator 1105, change type of bristles on the rotating agitator 1105, and/or remove the rotating agitator 1105 entirely depending on the intended application. The robotic cleaner 1100 may further include a bristle strip (not shown) on an underside of the housing 1102 and along a portion of the suction conduit 1155. The bristle strip may include bristles having a length sufficient to at least partially contact the surface to be cleaned. The bristle strip may also be angled, for example, toward the suction conduit 1155. Similarly, the robotic cleaner 1100 may further include an elastomeric strip (not shown) on an underside of the housing 1102 and along a portion of the suction conduit 1155. The elastomeric strip may have a length sufficient to at least partially contact the surface to be cleaned. The elastomeric strip may also be angled, for example, toward the suction conduit 1155

The robotic cleaner 1100 may also include one or more sensors, wherein the one or more sensors may include a plurality of sensors, at least one of which being of a type different from another. For example, the robotic cleaner 1100 may include one or more forward obstacle sensors 1108 (e.g., infrared sensors, ultrasonic sensors, optical sensors, a camera, or time-of-flight sensors), which cooperate with and/or are integrated with the bumper to detect the proximity of obstacles in front of the bumper. Additionally, or alternatively, the robotic cleaner 1100 may include one or more floor type detection sensors 1148 and 1188 (e.g., an acoustic sensor, an optical sensor, or ultrasonic sensor), which may be used to detect qualities of the surface to be cleaned and/or changes in the qualities of the surface to be cleaned. In some embodiments, the forward obstacle sensors 1108 or other sensors are mounted on the housing 1102 of the robotic cleaner 1100. The forward obstacle sensors 1108 placed on the housing 1102 may generate signals that pass through a bumper using holes and/or windows.

The one or more floor type detection sensors 1148 and 1188 can be any suitable sensors operable to detect a physical condition or phenomena and provide the corresponding data to a controller directing the robotic cleaner's 1100 behavior such as movement, cleaning mode, suction motor strength, and/or escape behaviors. In some embodiments, the algorithms that control the robotic cleaner's 1100 behavior are selected based on the determination of the surface type by the floor type detection sensors 1148 and 1188. In other embodiments, the algorithms that control the robotic cleaner's 1100 behavior are selected based on the identification of a change of the surface type by the floor type detection sensors 1148 and 1188.

At least a portion of the wet cleaning member 1191 (e.g., the liquid-permeable brush roll 1192) may be removably coupled to the robotic cleaner chassis 1102. The wet cleaning member 1191 may include the liquid-permeable brush roll 1192 (e.g., a wet cleaning brush roll), wherein the liquid-permeable brush roll 1192 is rotatable relative to the chassis 1102. The liquid-permeable brush roll 1192 may have bristles, fabric, sponge, microfiber cloth or other cleaning elements, or any combination thereof around the outside of the liquid-permeable brush roll 1192. The liquid-permeable brush roll 1192 may include, for example, strips of bristles in combination with strips of a rubber or elastomer material. The liquid-permeable brush roll 1192 rotates about a substantially horizontal axis during the movement of the robotic cleaner 1100 over a surface to be cleaned. The liquid-permeable brush roll 1192 is at least partially disposed within the robotic cleaner chassis 1102. The liquid-permeable brush roll 1192 may be coupled to a liquid cleaning module motor (or drive mechanism) 1193, such as an AC or DC electrical motor, to cause the liquid-permeable brush roll 1192 to rotate about an axis 1002 (e.g., a substantially horizontal axis), for example, by way of one or more drive belts, gears or other driving mechanisms. The liquid cleaning module motor 1193 may be coupled to the robotic cleaner chassis 1102.

Figure 3A:
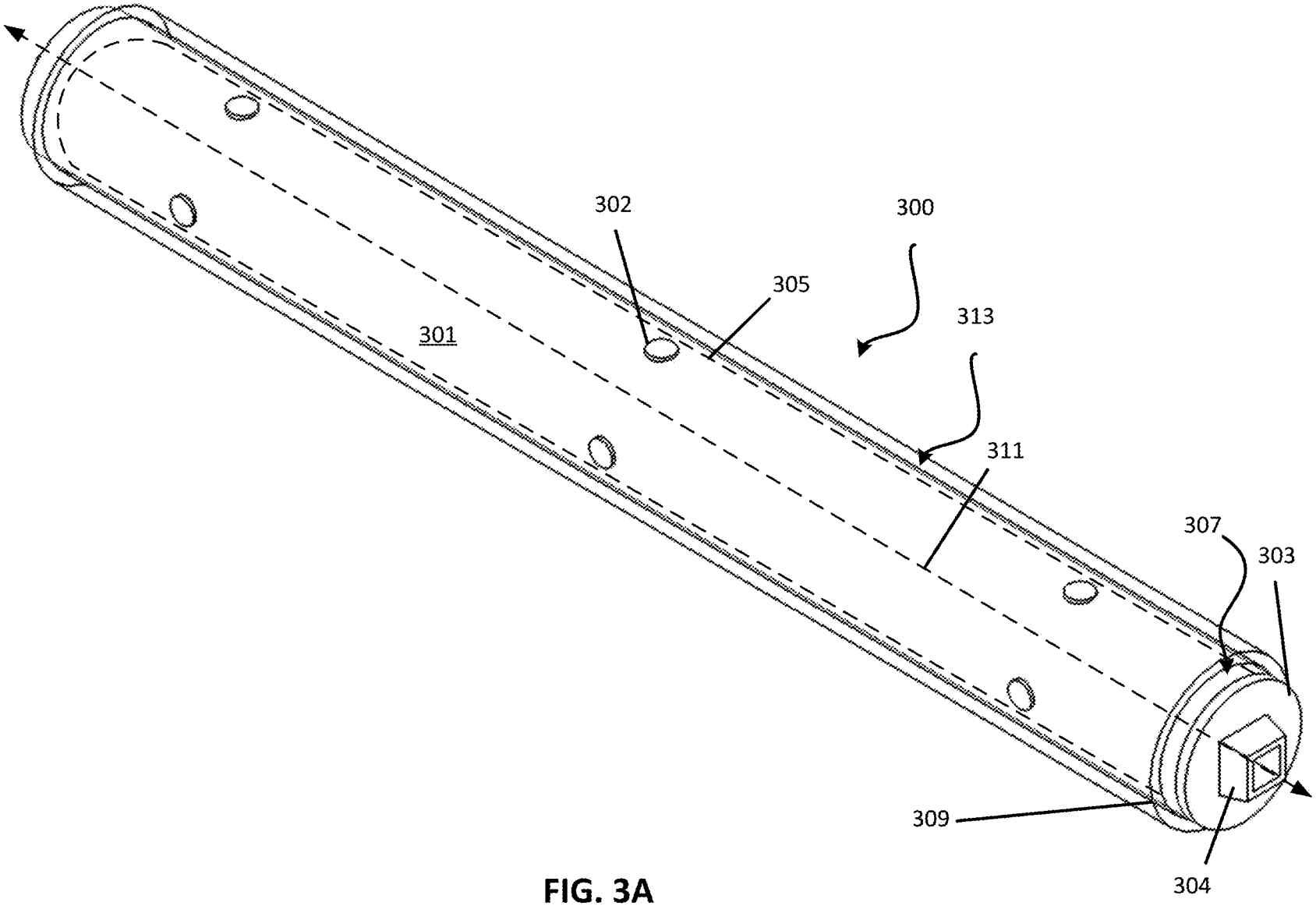
FIG. 3A is a schematic view of a wet cleaning member (e.g., in the form of a liquid-permeable brush roll), consistent with embodiments of the present disclosure.
Figure 3B:
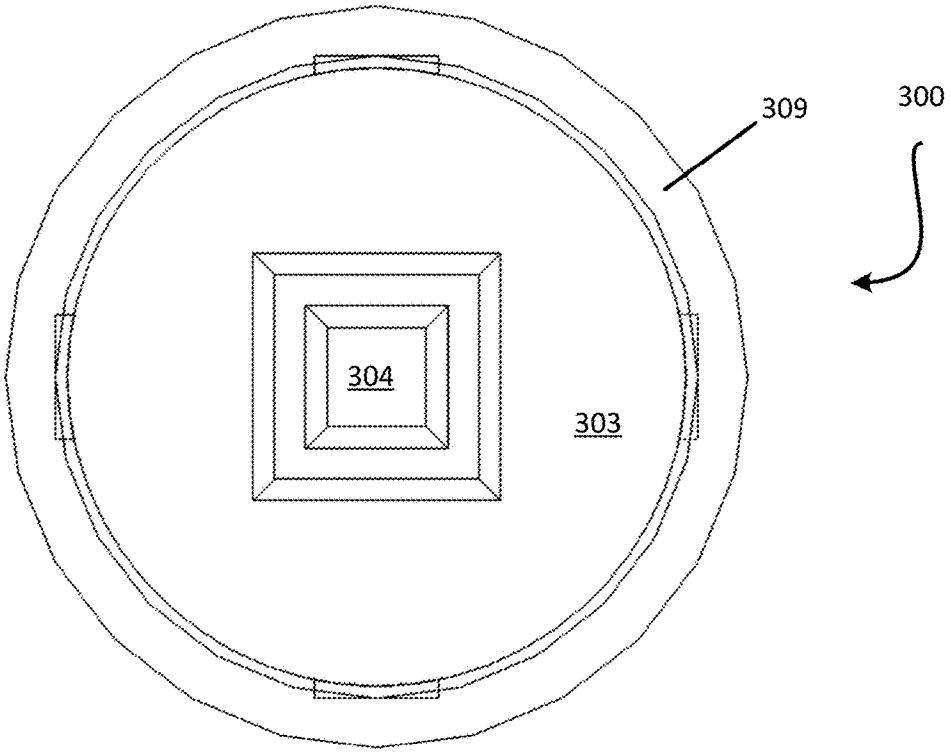
FIG. 3B is another schematic view of the wet cleaning of FIG. 3A, consistent with embodiments of the present disclosure.
Figure 3C:
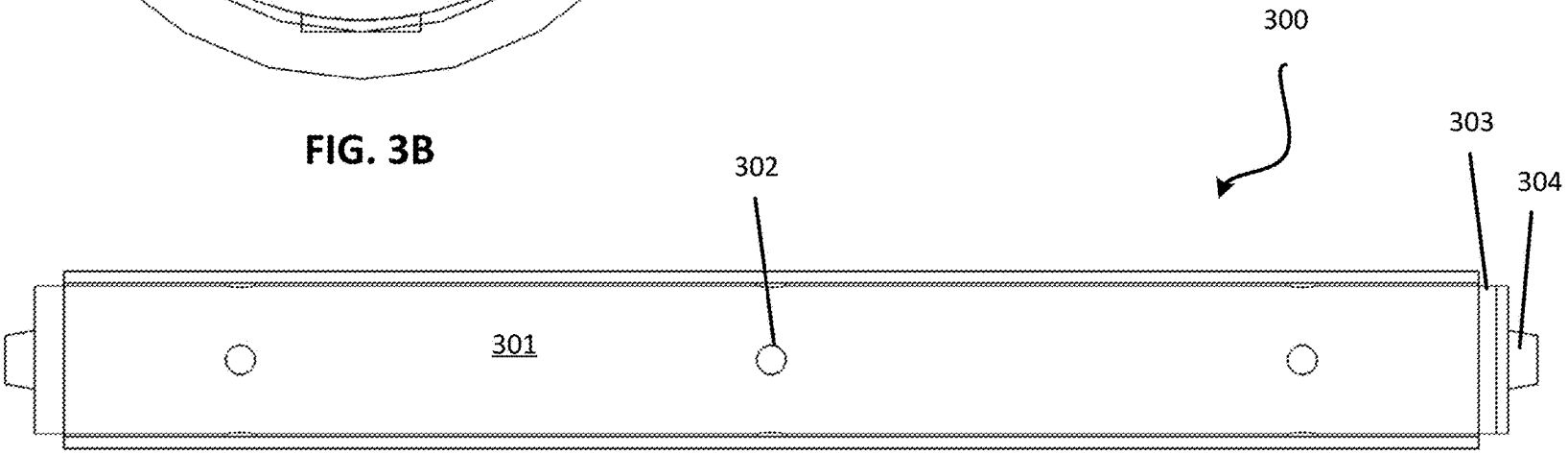
FIG. 3C is another schematic view of the wet cleaning member of FIG. 3A, consistent with embodiments of the present disclosure.

Referring to FIGS. 3A-3C, an embodiment of a wet cleaning member 300 capable of being used in a cleaner such as a robotic cleaner is shown. The wet cleaning member 300 may be an example of the wet cleaning member 1191. When a robotic cleaner is operating in a wet cleaning mode, the wet cleaning member 300 is agitated across a surface to be cleaned. The wet cleaning member 300 includes a main body 301, a cavity 305 (shown in hidden lines) having an open end 307, the cavity 305 extending within the main body 301, and a stopper 303 removably coupled to the main body 301 at the open end 307. The stopper 303 includes an attachment mechanism 304 configured to engage a drive mechanism, wherein actuation of the drive mechanism causes the wet cleaning member 300 to rotate. As shown, the cavity 305 extends longitudinally along the main body 301 such that the open end 307 is disposed at a distal end of the main body 301 and a longitudinal axis 311 of the main body 301 extends through the open end 307.

In some instances, the wet cleaning member 300 can be configured to store a cleaning fluid therein. For example, a cleaning fluid may be stored within the cavity 305 of the main body 301. As such, the cavity 305 may generally be described as a cleaning fluid reservoir. The cavity 305 may receive the cleaning fluid through the open end 307 of the cavity 305. As such, the stopper 303 can be configured to sealingly engage the main body 301 at the open end 307 such that the cleaning fluid is prevented (or substantially prevented) from leaving the cavity 305 through the open end 307 of the cavity 305. Therefore, the wet cleaning member 300 may, in some instances, generally be described as being a liquid-permeable brush roll having a cleaning fluid reservoir (or tank).

In an example embodiment, the cavity 305 may be configured to receive approximately 200 milliliters (ml) of cleaning fluid. In other words, a volume of the cavity 305 may be at least 200 ml. The cleaning fluid may be water or a mixture of water and soap or detergent that may further include other components such as a solvent, a fragrance, a disinfectant, a drying agent, abrasive particulates and/or the like to increase the effectiveness of the cleaning process or improve the end-results such as floor appearance. In some instances, for example, the mixture may be provided in a concentrated state and may be diluted to a desired concentration within the wet cleaning member 300. In this example, the mixture may be mixed as a result of agitation (e.g., rotation) of the wet cleaning member 300 (e.g., during a mixing mode or cleaning operation).

The wet cleaning member 300 can be further configured such that cleaning fluid stored in the cavity 305 of the main body 301 can be released from the cavity 305 at one or more locations along a radial (or outer circumferential) surface 313 of the main body 301. As such, the cleaning fluid can be applied on to a surface during cleaning operations.

For example, one or more weep holes 302 may be defined in the main body 301 (e.g., in the radial surface 313) and be fluidly coupled to the cavity 305. In other words, the one or more weep holes 302 can extend from the radial surface 313 and into the cavity 305 that is defined in the main body 301. Agitation (e.g., rotation) of the main body 301 (e.g., the rotational velocity of the main body 301) may influence the rate at which cleaning fluid is dispensed from the weep holes 302. In some instances, the main body 301 may include an absorbent material (e.g., in the form of an outer sheath 309) that extends around the radial surface 313 of the main body 301 and extends over the one or more weeps holes 302. The absorbent material can be configured such that cleaning fluid dispensed from the weep holes 302 is wicked longitudinally along the wet cleaning member 300. For example, the weep holes 302 and absorbent material can be configured such that a substantial portion of the absorbent material is wetted by at least a portion of the cleaning fluid dispensed from the weep holes 302 within a predetermined period of time.

In some instances, the main body 301 may be defined by an absorbent material. In these instances, the main body 301 may not include the weep holes 302. For example, when the main body 301 is defined by an absorbent material, cleaning fluid within the cavity 305 of the main body 301 may be absorbed by the absorbent material and transition from the cavity 305 to the radial surface 313 such that the cleaning fluid can be disposed on the surface to be cleaned. Agitation of the main body 301 (e.g., a rotational velocity of the main body 301) may influence the rate at which cleaning fluid passes through the absorbent material.

The absorbent material may include a microfiber material. The microfiber material may include one or more weave patterns. These weave patterns may include looped fabric, waffle weave, cut loops, coral fleece, microfiber suede, dual pile, pearl towel, and/or twisted pile. The main body 301 may be formed such that the materials of the main body 301 are capable of withstanding water and temperature extremes sufficient for the main body 301 to be washed in a washing machine or dishwasher.

In some instances, the outer sheath 309 of the main body 301 may be removable from the wet cleaning member 300. For example, the outer sheath 309 may be configured to slidably engage (e.g., the radial surface 313) and/or removably couple to the main body 301 (e.g., at the radial surface 313). In some instances, the outer sheath 309 may be attached to the main body 301 using hook-and-loop fasteners and/or may be a cylindrical shape that slides over the main body 301. In some embodiments, the outer sheath 309 is constructed from a disposable material (e.g., a recyclable or biodegradable material).

Figure 11:
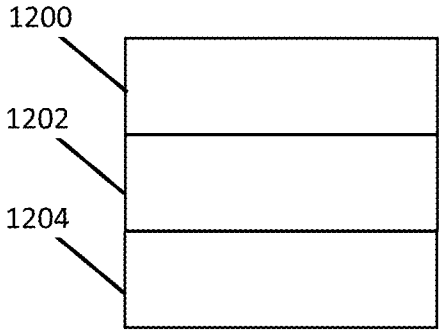
FIG. 11 shows a cross-sectional schematic view of a portion of a material capable of being used to form a multilayer outer sheath, consistent with embodiments of the present disclosure.

The outer sheath 309 may be formed of any suitable material and may be made of a single layer or multiple layers. For example, the outer sheath 309 may include at least an absorbent material. In one embodiment, the outer sheath 309 includes multiple layers such as a multifunctional strip, a face layer, and one or more absorbent layers. The face layer and one or more absorbent layers may be made from various non-woven materials, woven materials, plastics, and/or any other suitable materials. The face layer may be made with a hydrophobic material. The face layer (e.g., a layer having hydrophobic material) may be arranged such that cleaning fluid penetrates the face layer, wherein a weight of the robotic cleaner causes a sufficient pressure to be exerted on the face layer to cause at least a portion of the cleaning fluid to be applied to a surface to be cleaned while allowing at least a portion of the cleaning fluid to be retained by the face layer. The face layer may include a texture such as an embossed three-dimensional pattern to aid with capturing debris from the floor. The face layer may include a PET spunlace that is hydroentangled. In another embodiment, the one or more absorbent layers may be configured to wick moisture away from the face layer. The one or more absorbent layers may be formed of thermal bonded airlaid. A first absorbent layer may be formed with a suitable percentage of bi-component to increase mechanical stability and reduce wet collapse. A second absorbent layer may have a higher density airlaid than the first absorbent layer to promote liquid migration. The higher density airlaid provides mechanical structure to reduce compression and retain liquid. The multifunctional strip may be formed with hydrophilic meltblown polypropylene in some embodiments. FIG. 11 shows a cross-sectional schematic view of a portion of a material capable of being used to form a multilayer outer sheath having a face layer 1200, a first absorbent layer 1202, and a second absorbent layer 1204, wherein the first absorbent layer 1202 is disposed between the face layer 1200 and the second absorbent layer 1204.

In some embodiments, the wet cleaning member 300 may be coupled to a liquid cleaning module motor, such as an AC or DC electrical motor, to impart rotation, for example, by way of one or more drive belts, gears, or other driving mechanisms. The imparted rotation effectively agitates the wet cleaning member 300 during operation of the robotic cleaner. The liquid cleaning module motor may couple with the attachment mechanism 304 in order to drive the wet cleaning member 300.

In some embodiments, multiple wet cleaning members 300 operate at the same time. Multiple wet cleaning members may contain different cleaning fluids and/or that use different materials to perform operations such as scrubbing a surface, rinsing, and/or drying may be used. One or all of the wet cleaning members in such a system may be powered using one or more motors.

Figure 4:
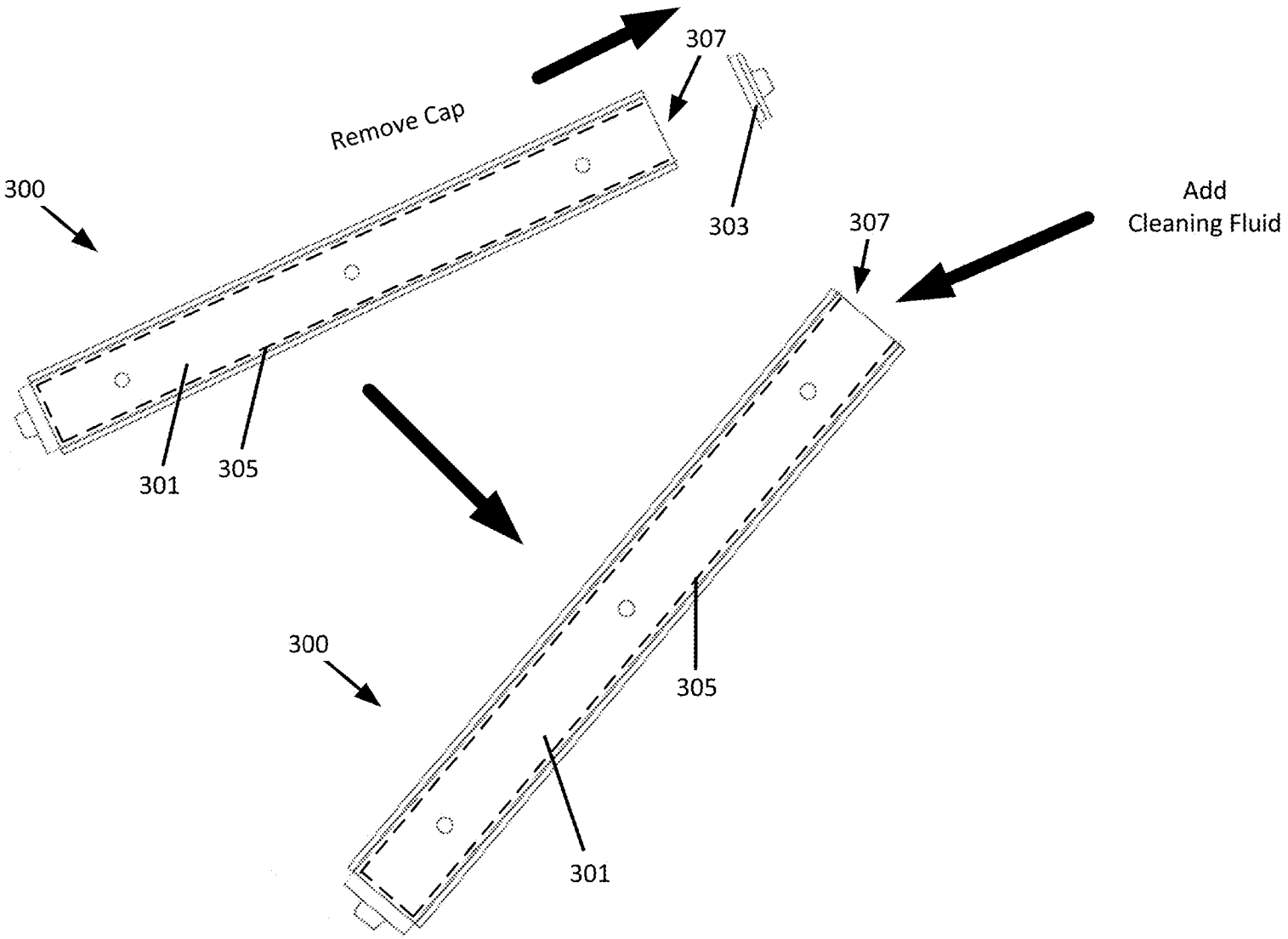
FIG. 4 illustrates an example of a process for a user to fill a cleaning fluid tank for a wet cleaning member such as the wet cleaning member of FIG. 3A, consistent with embodiments of the present disclosure.
Figure 5:
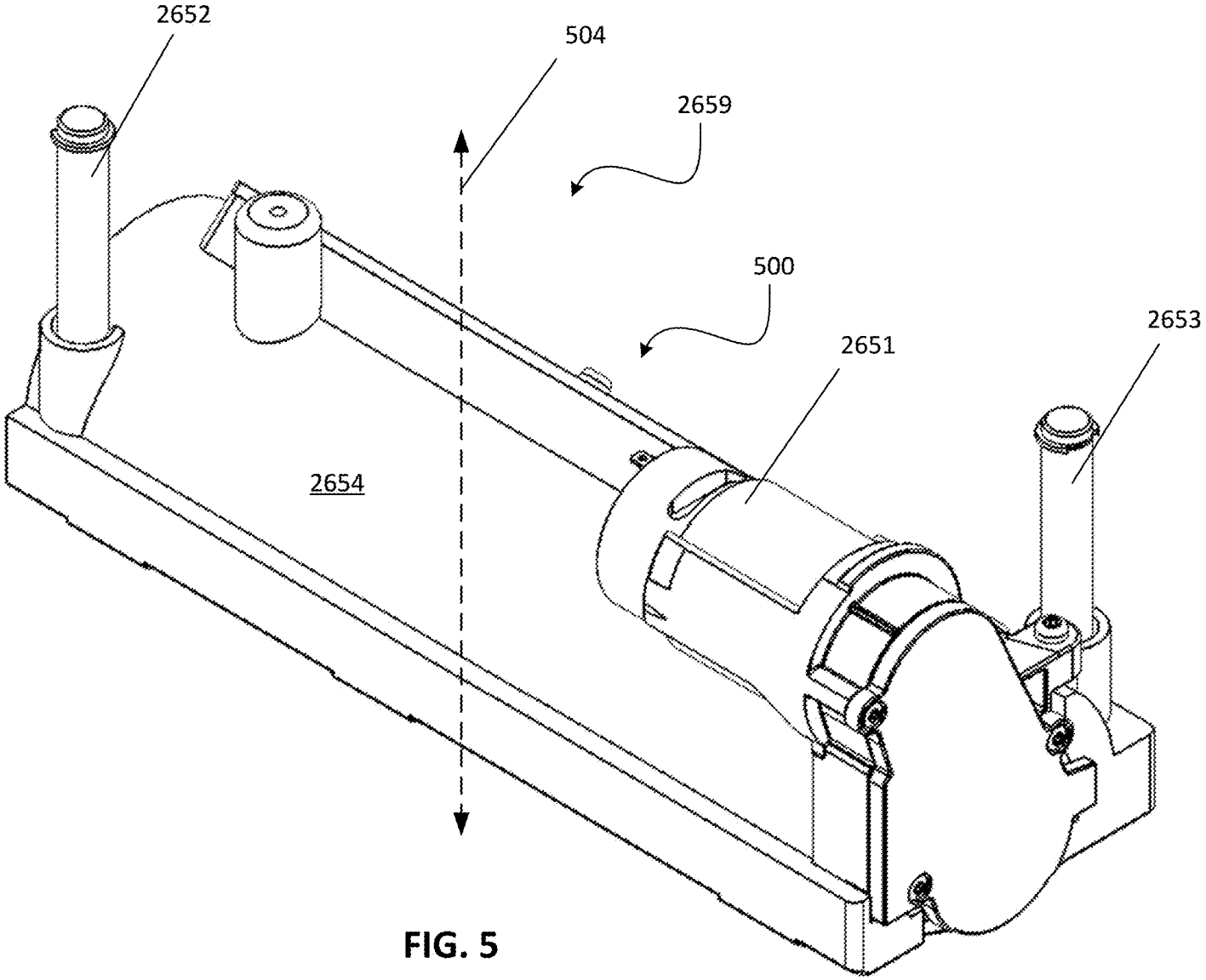
FIG. 5 is a schematic perspective view of a brush roll assembly of a robotic cleaner, consistent with embodiments of the present disclosure.
Figure 6A:
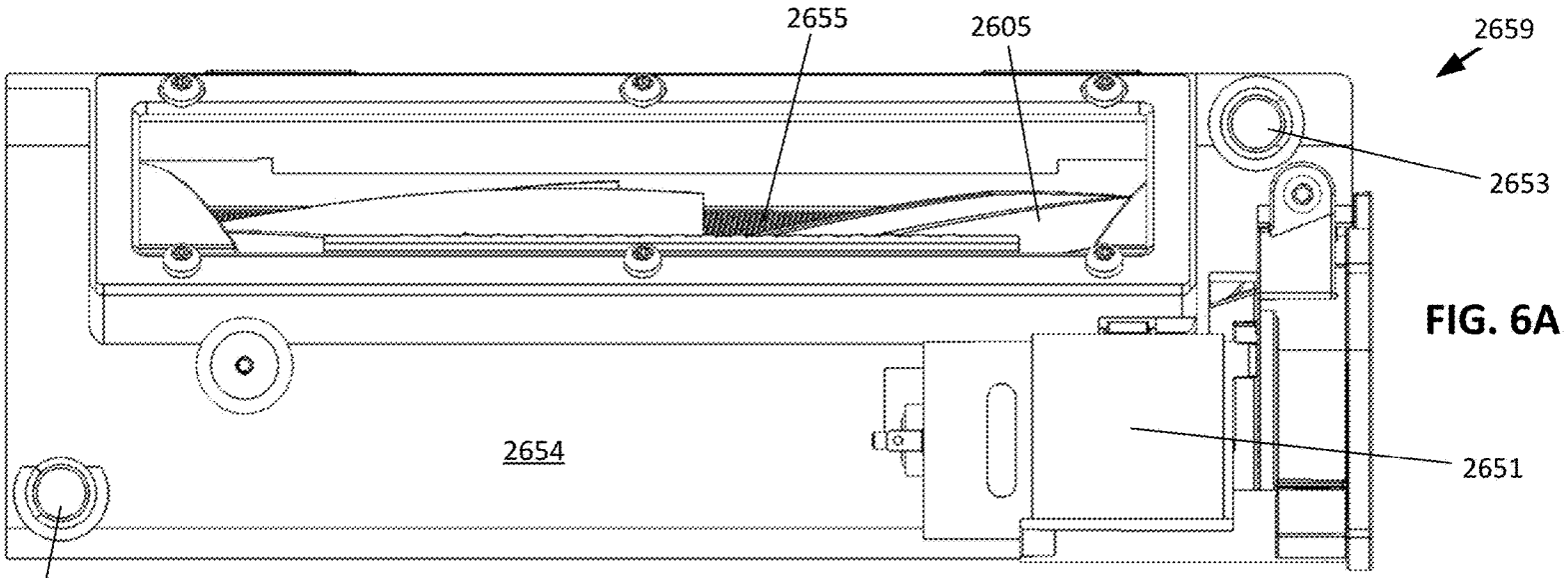
FIG. 6A is a schematic top view of the brush roll assembly shown in FIG. 5, consistent with embodiments of the present disclosure.
Figure 6B:
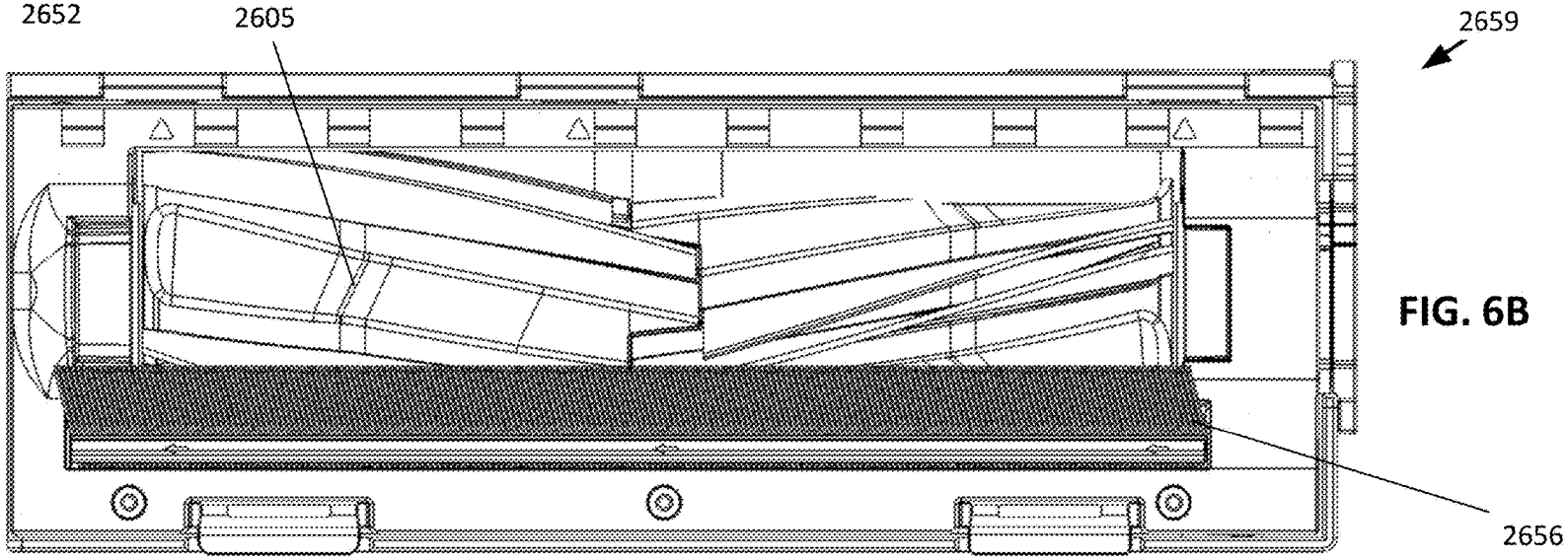
FIG. 6B is a schematic bottom view of the brush roll assembly shown in FIG. 5, consistent with embodiments of the present disclosure.
Figure 7B:
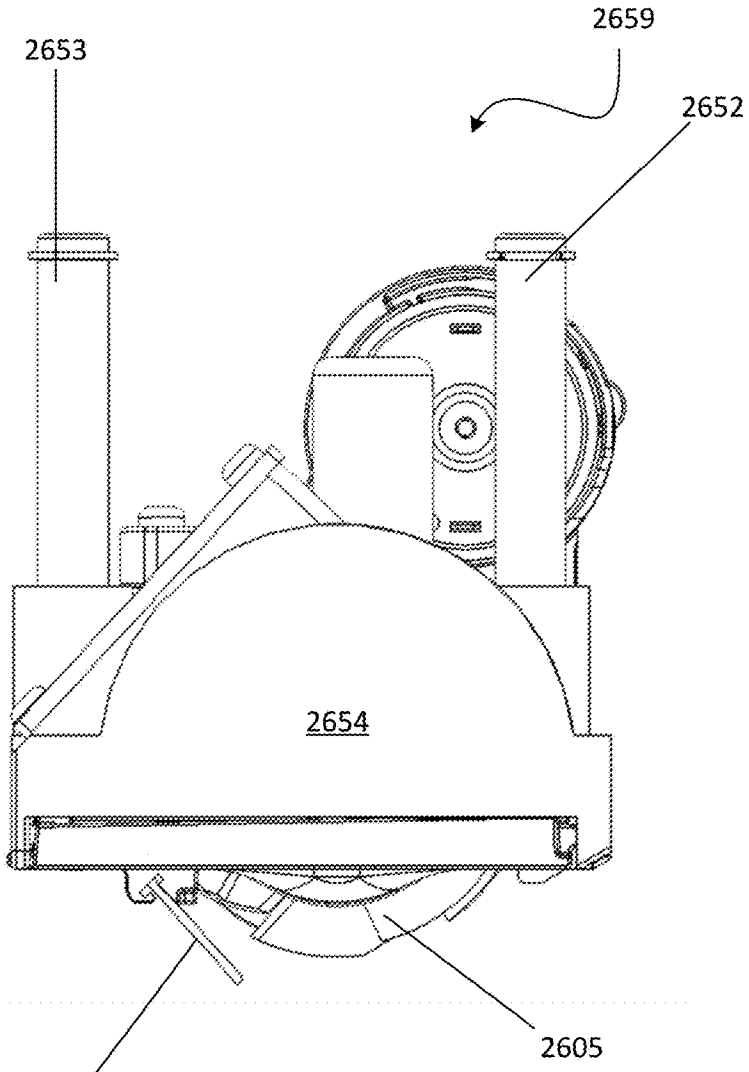
FIG. 7B is another schematic side view of the brush roll assembly shown in FIG. 5, consistent with embodiments of the present disclosure.
Figure 7A:
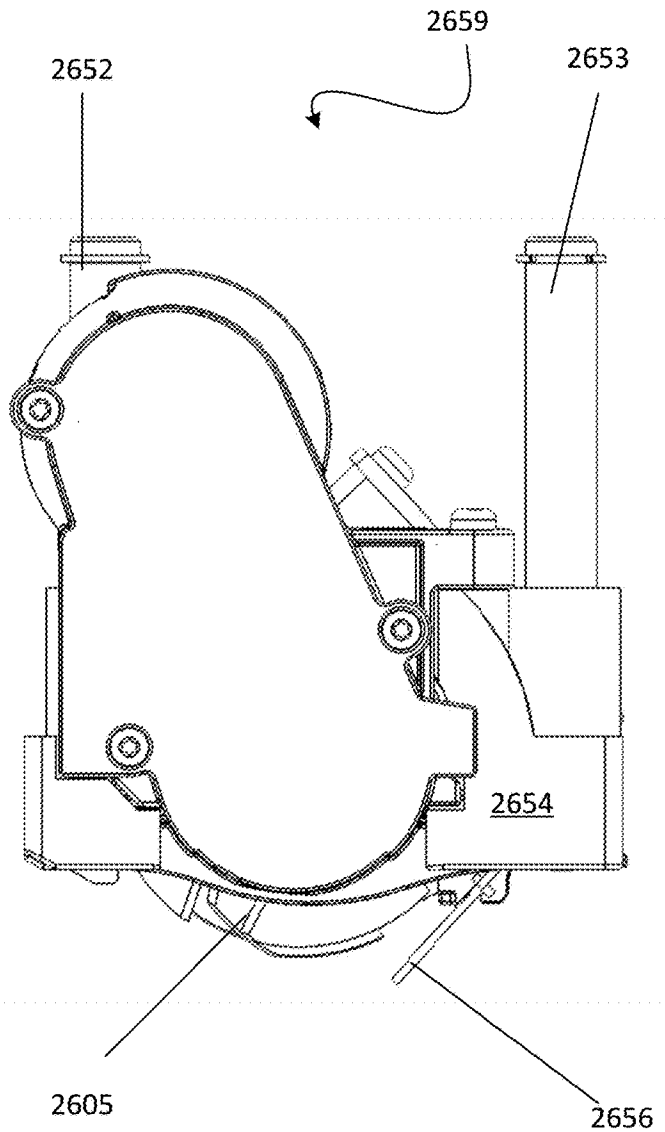
FIG. 7A is a schematic a side view of the brush roll assembly shown in FIG. 5, consistent with embodiments of the present disclosure.
Figure 8A:
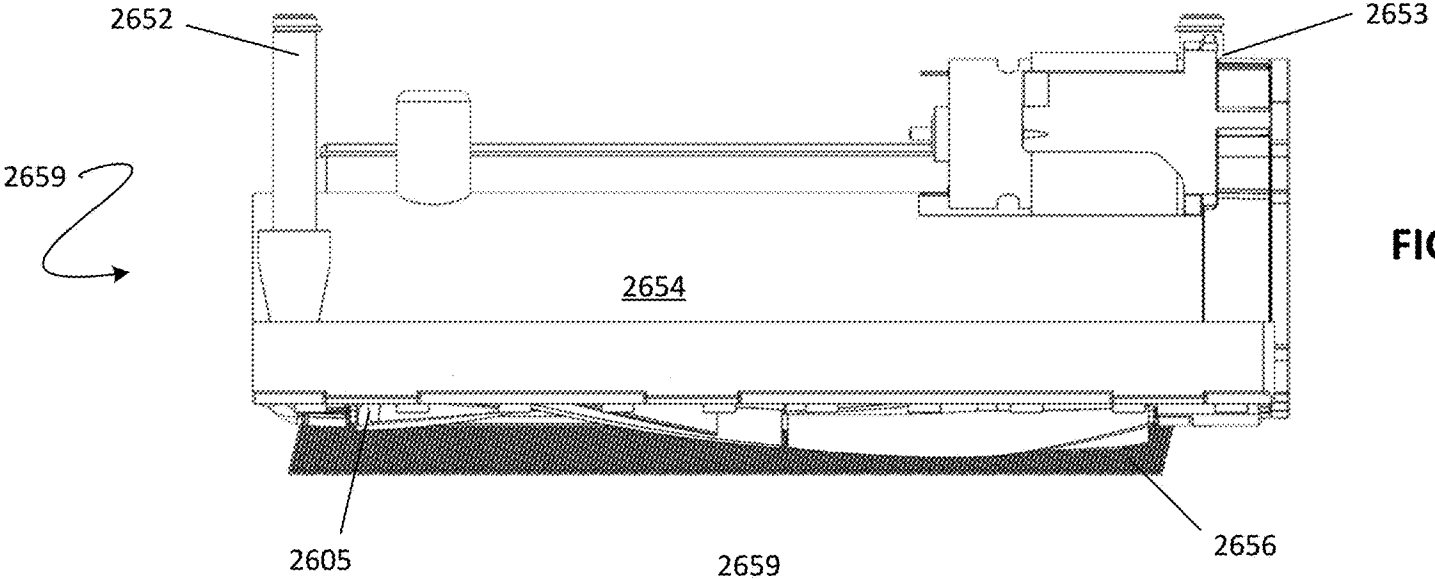
FIG. 8A is another schematic side view of the brush roll assembly shown in FIG. 5, consistent with embodiments of the present disclosure.
Figure 8B:
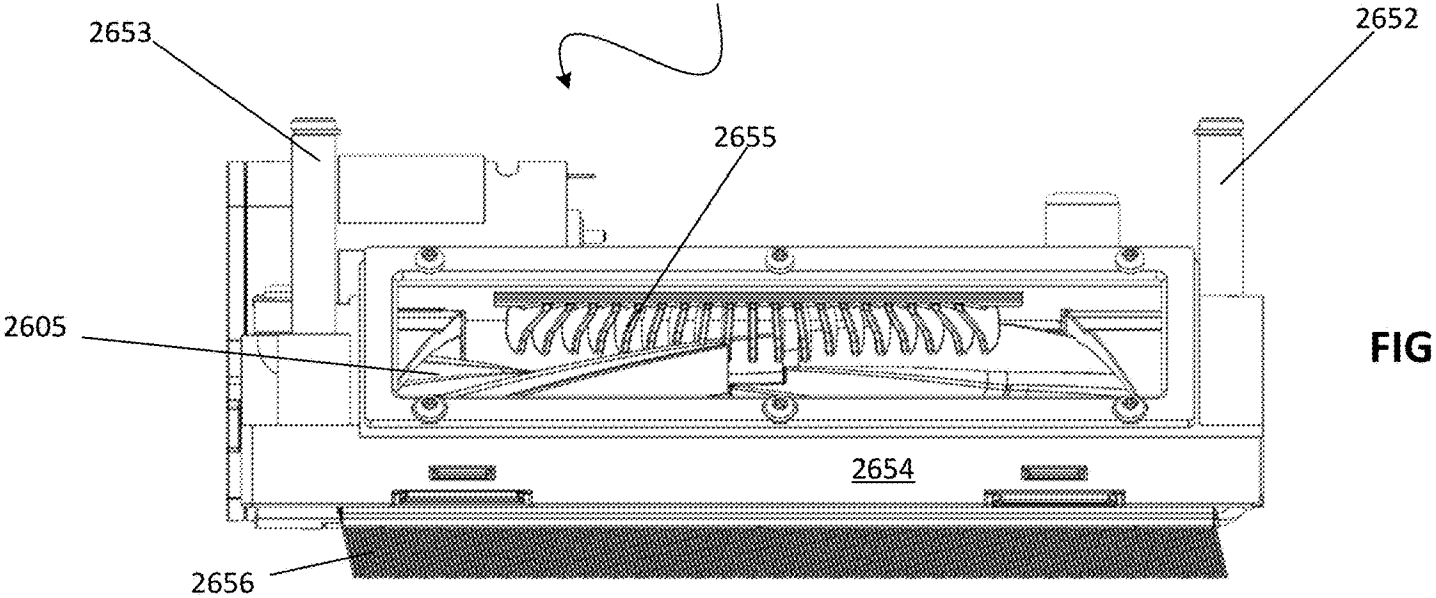
FIG. 8B is another schematic side view of the brush roll assembly shown in FIG. 5, consistent with embodiments of the present disclosure.
Figure 9A:
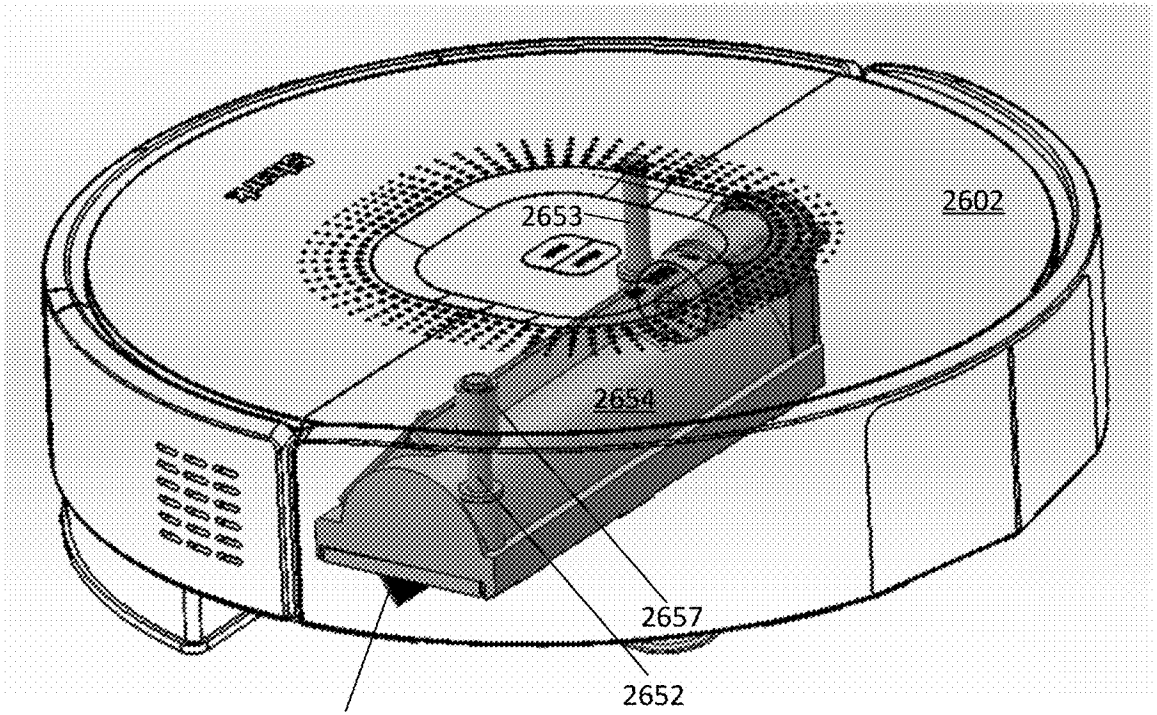
FIG. 9A is a schematic perspective view of the brush roll assembly shown in FIG. 5. placed within a chassis for a robotic cleaner, consistent with embodiments of the present disclosure.
Figure 9B:
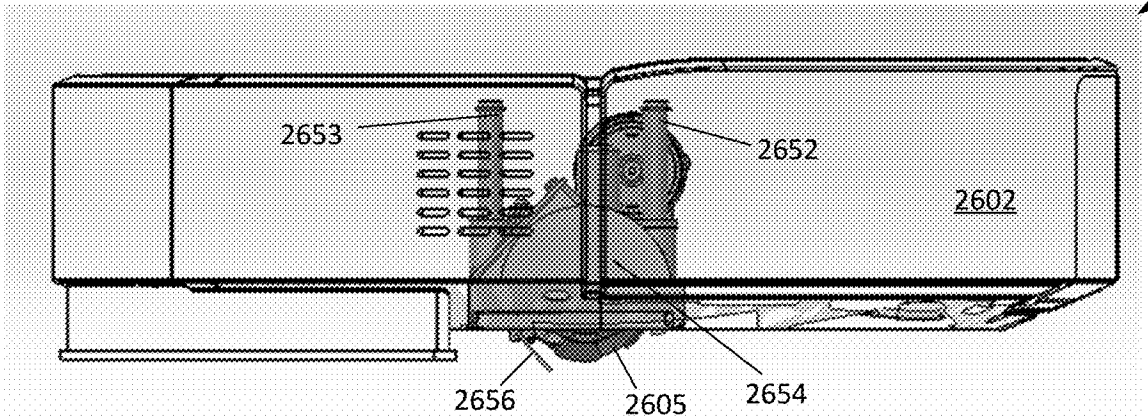
FIG. 9B is a schematic side view of the brush roll assembly shown in FIG. 5 placed within a chassis for a robotic cleaner, consistent with embodiments of the present disclosure.

The wet cleaning member 300 is constructed to be removable from a robotic cleaner. The stopper 303 is removably attached to the main body 301. As shown in FIG. 4, once the wet cleaning member 300 is removed from a robotic cleaner, the stopper 303 may be removed and cleaning fluid may be added to the wet cleaning member 300 via the open end 307 of the cavity 305.

In an embodiment, the wet cleaning member 300 may include a pumping mechanism (not shown). The pumping mechanism may control the movement of fluid from the main body 301 and onto, for example, the outer sheath 309.

As described above, and referring particularly to FIGS. 2A and 2B, the robotic cleaner 1100 includes a plurality of wheels 1130 coupled to a respective drive motor contained within a driven wheel assembly. When traveling over dry surfaces, the robotic cleaner 1100 may encounter a variety of different surfaces such as, but not limited to, carpet, tile, hard wood, and linoleum. When traveling over various surfaces, the wheels 1130 may experience changes in traction, which may result in increased wheel slip (e.g., wheel rotation that does not cause a corresponding movement of the cleaning robot 1100). In particular, travel over a carpeted surface may induce greater wheel slip than travel over a hard surface. As such, the wheels 1130 can be configured to provide sufficient traction on the various surfaces.

Use of the wet cleaning member 1191 may also be detrimental to maneuverability (e.g., as a result of increased wheel slip) of the robotic cleaner 1100 when traveling along a surface to be cleaned (e.g., a floor). For example, when the wet cleaning member 1191 includes a cleaning pad, the cleaning pad may introduce additional frictional forces on the robotic cleaner 1100 and/or dispensed cleaning liquid may reduce a frictional force generated between the wheels 1130 and the surface to be cleaned. The cleaning pad may increase the friction forces that the wheels 1130 must overcome in order to move the robotic cleaner 1100 along the surface to be cleaned. The degree of additional friction may vary depending on an amount of cleaning fluid absorbed by the cleaning pad and how the cleaning pad is being agitated during a cleaning operation. As such, the robotic cleaner 1100 can be configured to travel across a surface in the presence of a cleaning fluid and/or while using a cleaning pad.

The wheels 1130 may be formed of a variety of different materials. Softer materials may increase the traction of the wheels 1130 on hard surfaces but decrease performance on carpets. Softer materials may wear more quickly than harder materials. Treads pressed into the wheels 1130 may improve the traction of one or more wheels 1130. In these instances, a more durable material (e.g., a harder material) may be used. In some instances, the wheels 1130 may include a hub and a tire extending around the hub, the tire being configured to engage the surface to be cleaned. In other instances, the wheels 1130 may be a single solid body. The materials used for the wheels 1130 (e.g., the tire and/or hub) should be compatible with the cleaning fluid used during a wet cleaning operation, that is, the cleaning fluid should not substantially degrade or otherwise substantially harm the wheels 1130 over the lifetime of the robotic cleaner 1100.

At least a portion of the wheels 1130 may be formed from, for example, sponge rubber with a density of 640.74 kilograms (kg) per cubic meter, which may provide a desired amount of traction when a tread pattern is pressed into the material during molding. In particular, various chevron-based tread patterns may allow the robotic cleaner 1100 to operate more effectively while using the wet cleaning member 1191, which may increase drag on the robotic cleaner 1100. In other embodiments, the materials used to form at least a portion of the wheels 1130 (e.g., the portion including the treads) include neoprene and chloroprene, and other closed cell rubber sponge materials. At least a portion of the wheels 1130 may also be made of polyvinyl chloride (PVC) and acrylonitrile-butadiene (ABS) (with or without other extractables, hydrocarbons, carbon black, and ash).

Figure 10:
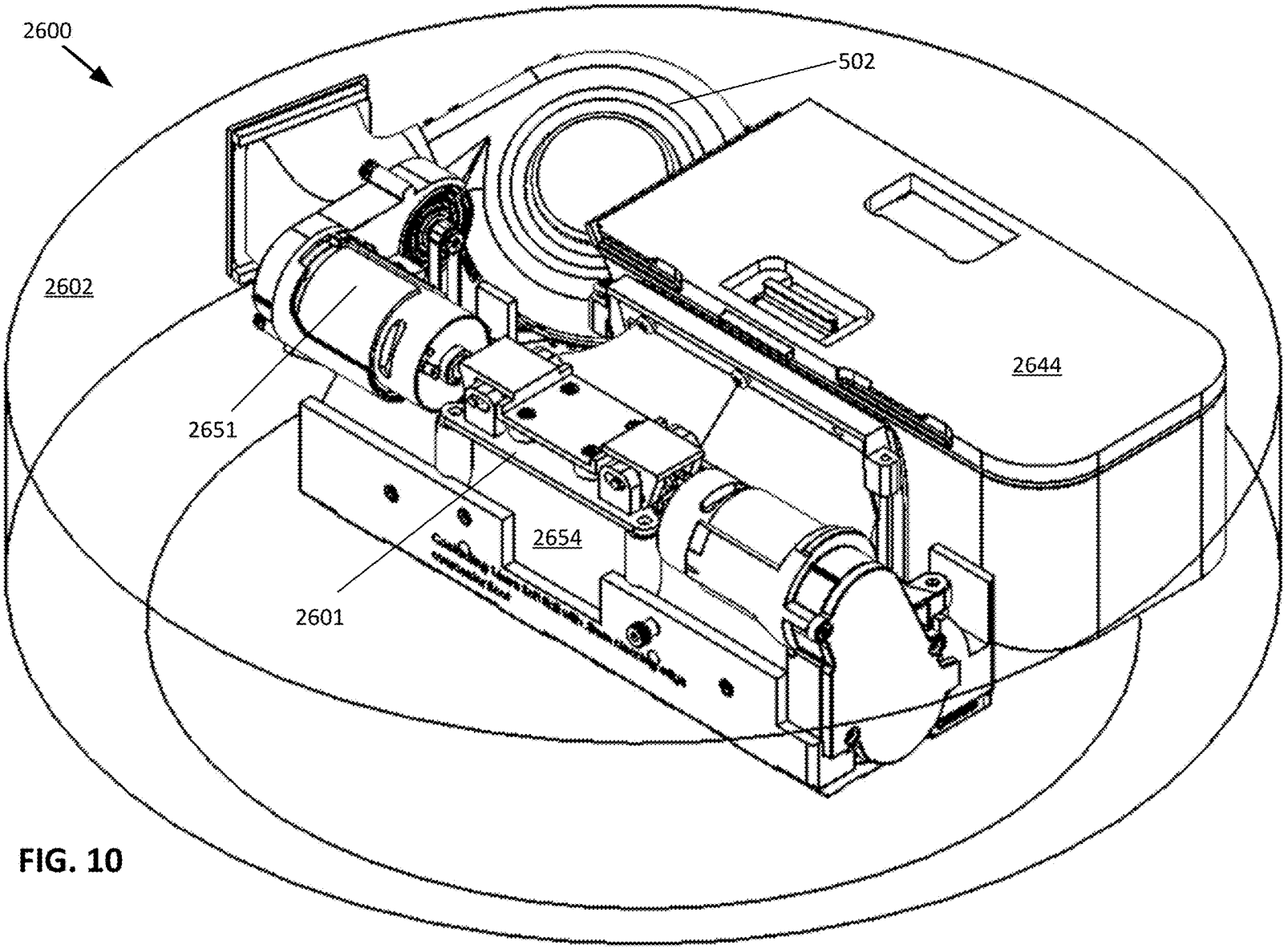
FIG. 10 depicts a robotic cleaner chassis having robotic cleaner subsystems attached thereto, such as the brush roll assembly shown in FIG. 5, consistent with embodiments of the present disclosure.

Referring now to FIGS. 5-10, a robotic cleaner 2600 includes a brush roll assembly 2659 carried by the robotic cleaner 2600 within a chassis 2602 of the robotic cleaner 2600. In the illustrated embodiment, the brush roll assembly 2659 includes a housing 2654, a motor 2651, a main brush roll (or dry cleaning agitator) 2605, a debrider comb 2655, and a rear bristle strip 2656. FIGS. 5-9B show the brush roll assembly 2659 being configured to float using a front sole plate pin 2652 and a rear sole plate pin 2653. FIG. 10 shows the brush roll assembly 2659 being configured to float using a moveable plate 2601. The brush roll assembly 2659 may generally described as being configured to float when one or more components of the brush roll assembly 2659 are capable of moving relative to the chassis 2602 in response to, for example, changes in the surface to be cleaned.

At least a portion of brush roll assembly 2659 is configured to be moveable relative to the chassis 2602 of the robotic cleaner 2600 as the robotic cleaner 2600 traverses a surface (e.g., a floor). As such, the brush roll assembly 2659 may generally be described as being configured to float relative to the chassis 2602. In other words, the brush roll assembly 2659 operates as a floating sole plate. Such a configuration may allow the brush roll assembly 2659 to maintain a lower planar surface that is generally parallel to a surface on which the robotic cleaner 2600 is moving.

The brush roll assembly 2659 can be configured such that at least a portion of the brush roll assembly 2659 maintains consistent engagement with a surface (e.g., substantially continuous contact with the surface). For example, the weight of the brush roll assembly 2659 may be configured such that at least a portion of the brush roll assembly 2659 maintains consistent engagement with the surface (e.g., at least a portion of the brush roll assembly 2659 continuously engages the surface). Additionally, or alternatively, the brush roll assembly 2659 may be urged towards the surface using a biasing mechanism (e.g., a spring).

As shown, as the robotic cleaner 2600 traverses a surface to be cleaned (e.g., a floor), the brush roll assembly 2659 is configured to move in response to changes in the surface to be cleaned (e.g., changes in floor type). For example, the brush roll assembly 2659 can be configured to move generally along a drop axis 504 (e.g., an axis that extends generally perpendicular to the surface to be cleaned). The brush roll assembly 2659 may be slidably coupled to the chassis 2602 using the front and rear sole plate pins 2652 and 2653. For example, the front and rear sole plate pins 2652 and 2653 may be slidably coupled to the chassis 2602 of the robotic cleaner 2600 such that the brush roll assembly 2659 can move relative to the chassis 2602. In these instances, the chassis 2602 may include a plurality of shrouds 2657, each configured to slidably receive a corresponding one of the front and rear sole plate pins 2652 and 2653. The one or more shrouds 2657 may be coupled to or formed from the robotic cleaner chassis 2602. As shown, the front and rear sole plate pins 2652 and 2653 may extend in a direction generally parallel to the drop axis 504.

In some instances, the brush roll assembly 2659 can be configured to move relative to the front and rear sole plate pins 2652 and 2653. For example, the front and rear sole plate pins 2652 and 2653 may be fixedly attached to the chassis 2602 of the robotic cleaner 2600 (e.g., using the shrouds 2657). In this example, during the movement of the robotic cleaner 2600 over, for example, an uneven surface, the brush roll assembly 2659 moves up and down along the two or more pins 2652 and 2653. In other words, the brush roll assembly 2659 translates vertically along the front sole plate pin 2652 and the rear sole plate pin 2653. The displacement of the brush roll assembly 2659 may range from 9 millimeters (mm) to 11 mm along the drop axis 504. The displacement of the brush roll assembly 2659 may allow the robotic cleaner 2600 to operate more effectively on multiple types of surfaces.

The surface on which the robotic cleaner 2600 travels may displace the brush roll assembly 2659 from its lowest point such that the brush roll assembly 2659 moves upwards into the robotic cleaner chassis 2602. Carpet, hard wood, tile, rugs, and other flooring types have different features that determine the displacement of the brush roll assembly 2659. The distance between the brush roll assembly 2659 and the surface to be cleaned may influence the strength of suction provided by the robotic cleaner 2600 and/or the interactions between the main brush roll 2605 and the surface to be cleaned. Additional engagement between the main brush roll 2605 and the surface to be cleaned may increase agitation of the surface and allow additional dry debris to be suctioned into the dust cup 2644.

Movement of the brush roll assembly 2659 adjusts the vertical position of the main brush roll 2605 relative to the upper portion of the robotic cleaner chassis 2602 to accommodate different surfaces. The front and rear sole plate pins 2652 and 2653 can be configured to constrain the overall movement of the brush roll assembly 2659. For example, the front and rear sole plate pins 2652 and 2653 can limit a maximum extension distance of the brush roll assembly 2659 as measured from a bottom surface of the chassis 2602. In some instances, the maximum extension distance may only be achieved when the robotic cleaner 2600 is removed from the surface to be cleaned (e.g., when picked up by a user).

The brush roll assembly 2659 includes a suction conduit 500 fluidly coupled to a dust cup 2644 and a suction motor 502. The suction motor 502 causes debris to be suctioned into the suction conduit 500 and deposited into the dust cup 2644 for later disposal. The suction conduit 500 may include a flexible material, which may enable movement of the brush roll assembly 2659.

Additionally, or alternatively, to the floating brush roll assembly 2659 the robotic cleaner 2600 may include a floating wet cleaning member (e.g., the wet cleaning member 1191). A floating wet cleaning member may be configured to float in a similar manner as is described in relation to the floating brush roll assembly 2659. As such, the robotic cleaner 2600 may be generally described as having one or more of a floating dry cleaning agitator and/or a floating liquid-permeable brush roll, wherein the floating dry cleaning agitator and/or floating liquid-permeable brush roll are configured to float relative to the chassis 2602 of the robotic cleaner 2600.

A cleaning robot, consistent with the present disclosure, may include a chassis and a drive system configured to autonomously transport cleaning elements over a target surface (or surface to be cleaned such as a floor). The drive system includes one or more driven wheels, wherein the cleaning robot is supported on the target surface by the one or more driven wheels. The one or more driven wheels are in rolling contact with the target surface and the robot is configured to control the one or more driven wheels in order to direct the robot to generally traverse the target surface (e.g., in a forward direction defined by a fore-aft axis). A transverse axis may extend perpendicular to the fore-aft axis. The one or more driven wheels may be driven by a respective drive motor, each drive motor may be controlled by a controller.

In some instances, the cleaning robot may include at least two separate cleaning modules. The cleaning modules may operate separately or in coordination. In these instances, the cleaning robot may generally be referred to as a modular cleaning robot. The modular cleaning robot may include a first cleaning module configured to collect dry debris from the target surface and a second cleaning module configured to perform wet cleaning using a wet cleaning member. The cleaning robot may also include at least two containers or compartments, carried thereby, to store debris collected by the first cleaning module and to store cleaning fluid to be used by the second cleaning module.

In some instances, the cleaning robot includes a dry waste storage container, compartment, or tank attached to the chassis and arranged to receive the debris therein. Additionally, or alternatively, the cleaning robot may include a cleaning fluid storage container, compartment, bladder, or tank attached to the chassis and configured to store a supply of the cleaning fluid therein. The stored cleaning fluid may be applied to a wet cleaning member for using in cleaning the target surface. In some embodiments, the cleaning fluid comprises water or water mixed with any one or more of soap, solvent, fragrance, disinfectant, emulsifier, drying agent and/or abrasive particulates.

In some instances, a liquid-permeable brush roll may include (e.g., define) the cleaning fluid storage container. For example, the cleaning robot may include a wet cleaning module having a liquid-permeable brush roll. The liquid-permeable brush roll is configured to apply the cleaning fluid onto a target surface being cleaned while cleaning robot traverses the target surface. In some instances, the cleaning robot includes a wet cleaning module motor configured to rotate the liquid-permeable brush roll. Rotation of the liquid-permeable brush roll causes the liquid-permeable brush roll to scrub the target surface while the cleaning robot traverses the target surface. The wet cleaning module may be configured to interface with a gear train that is coupled to the drive shaft of the wet cleaning module motor. The wet cleaning module motor may be coupled to the chassis of the cleaning robot.

In some embodiments, the dry waste container is configured to be removable from the chassis by a user and to be emptied by the user. In other embodiments, the dry waste container is configured to not be removable from the chassis by a user and to be emptied by the user. Still other embodiments include a cleaning fluid storage container that is attached to the chassis, configured to store a supply of the cleaning fluid therein, and configured to deliver the cleaning fluid to a liquid applicator. In some instances, the cleaning fluid storage container is configured to be removable from the chassis by the user and to be filled by the user. The cleaning fluid storage container can be configured such that the cleaning fluid is isolated from one or more motors, drive devices, and/or any other electronic parts contained within the cleaning robot chassis.

In some instances, the cleaning robot may include one or more driven wheels attached to chassis for transporting the cleaning robot over the target surface, one or more motors attached to the chassis configured to cause a respective driven wheel to rotate, and a controller located within the chassis for controlling the one or more motors. The cleaning robot may further include a collecting apparatus and a liquid applicator, wherein the collecting apparatus and the liquid applicator may cooperate to clean the target surface. The cleaning robot may also include a plurality of sensors configured to sense one or more of conditions external to the cleaning robot and/or conditions internal to the cleaning robot and to generate sensor signals in response to sensing the conditions. The controller may be configured to receive the sensor signals and to implement predefined operating modes in response to receiving the sensor signals, wherein each sensor signal is indicative of a corresponding internal or external condition of the robot.

In some instances, the cleaning robot may include a user interface that is configured to receive an input from a user. The user interface may be communicatively coupled to the controller. The controller may be configured to cause the cleaning robot to implement one or more predefined operating modes of the robot in response to the input, wherein the one or more predefined operating modes correspond to a respective input. In some instances, the user interface can be attached to the chassis. In some instances, the cleaning robot can receive one or more inputs from a remote control that is configured to receive one or more inputs from a user. In response to receiving one or more inputs from the remote control, the controller may implement one or more predefined operating modes of the cleaning robot, which correspond to a respective input. In still other embodiments, the cleaning robot may include a wireless component configured to communicate with a mobile application (e.g., operating on a mobile device such as a smart phone). The mobile application can be configured to receive one or more inputs from a user and cause the one or more inputs to be transmitted to the controller via the wireless component, wherein, in response to receiving the one or more inputs, the controller may implement one or more predefined operating modes, which correspond to a respective input. In some instances, the robotic cleaner may have a circular cross-section having a vertical center axis, wherein the fore-aft axis, the transverse axis, and the vertical center axis are perpendicular to each other. The controller is configured to operate the one or more driven wheels (e.g., operate a plurality of driven wheels at differing rotation speeds) to rotate the cleaning robot about the vertical center axis, changing an orientation of the forward travel direction.

In some instances, the cleaning robot may include a floating sole plate. The sole plate may define a portion of a bottom surface of the cleaning robot. The floating soleplate may move along a drop axis (e.g., a vertical axis). The drop axis extends transverse to a target surface on which the robotic cleaning apparatus is moving. The floating soleplate may move by translating along the drop axis. For example, the sole plate may move along the drop axis such that the sole plate remains substantially/generally (e.g., within 1°, 2°, 3°, 4°, or 5° of) parallel to the target surface while moving up and down (e.g., along two or more pins). In some instances, a four bar linkage may allow for vertical translation of the floating soleplate.

According to another aspect of the present disclosure, a surface treatment robot may include a robot body and at least two drive members that drive the robot body along a target surface. The surface treatment robot may also include a fluid compartment that holds fluid to be dispensed by the surface treatment robot and at least one cleaning member to scrub a target surface, with the assistance of dispensed fluid. The at least one cleaning member is positioned substantially perpendicular to the forward movement of the robot body and such that the at least one cleaning member scrubs an area aft of a suction conduit.

The cleaning member may be a cleaning pad having a leading edge measuring about 31.75-33.02 centimeters (cm) and the surface treatment robot may have a weight of about 2.95 kilograms (kg). The robot weight may urge the cleaning pad into engagement with a target surface (e.g., a floor), improving cleaning efficiency. In some embodiments, a rear caster wheel may be used to control the engagement of the cleaning pad with the target surface. The pressure applied to the cleaning pad may be distributed across the cleaning pad or concentrated along a leading edge of the cleaning pad to improve cleaning while limiting an amount of drag caused by the cleaning pad engaging with the target surface. The rear caster wheel also improves the ability of the robotic cleaner to cross over thresholds while cleaning. In some embodiments, the cleaning member is constructed of a reusable microfiber material.

In some instances, a surface treatment robot may include one or more sensors to determine the type of surface on which it is moving. The one or more sensors can be any suitable sensors operable to detect a physical condition or phenomena and provide the corresponding data to a controller directing the behavior of the surface treatment robot (e.g., movement, cleaning, and/or escape behaviors). In some embodiments, the algorithms that control the surface treatment robot behavior are selected based on the determinization of the surface type. An embodiment includes a method for detecting the floor using an ultrasonic sensor. Such a floor sensor may include an ultrasonic transmitter configured to transmit an ultrasonic signal toward a target surface (e.g., a floor) and an ultrasonic receiver to receive the ultrasonic signal reflected from the target surface. The sensor allows for determination of floor types such as carpet, hardwood, or tile based on the reflective conditions of the floor.

In another embodiment, a method for detecting the floor type includes an acoustic sensor such as a microphone which can detect ambient noise. As a surface treatment robot traverses a target surface, noise from the surrounding area may be detected using an acoustic sensor. The volume and quality of that noise may vary based on the qualities of the surface (e.g., the floor) such that the acoustic sensor allows for determination of floor types such as carpet, hardwood, or tile based on the reflective conditions of the floor. In some embodiments, the noise that the surface treatment robot generates while moving is used by an acoustic sensor to determine floor type.

In a further embodiment, a method for detecting the floor type includes an optical sensor such as an emitter that emits light and a detector that can detect reflected light. The reflective qualities of the surface (e.g., the floor) can be used for determination of floor types such as carpet, hardwood, or tile.

In another embodiment, the dry debris cleaning module may utilize one or more side brush assemblies disposed on the chassis of the robotic cleaner and may be configured to move along the target surface such that debris is swept into the path of the dry debris cleaning module. A suction conduit can be disposed on the underside of the robot chassis and can be situated substantially perpendicular to the fore-aft axis (e.g., a longitudinal axis of the suction conduit is substantially perpendicular to the fore-aft axis) to suction up debris in the path of the dry debris cleaning module as the robot traverses the target surface. In various embodiments the dry debris cleaning system is disposed fore of a wet cleaning system.

In accordance with an embodiment of the present disclosure, at least one driven wheel may include a wheel and/or tire material (e.g., a sponge rubber) with a density of, for example, 640.74 kg per cubic meter. Additionally, or alternatively, the wheel and/or tire material may be neoprene, chloroprene, or other closed cell rubber sponge materials. Additionally, or alternatively, the wheel and/or tire material may be polyvinyl chloride (PVC), or acrylonitrile-butadiene (ABS) (with or without other extractables, hydrocarbons, carbon black, and ash). In certain embodiments, the wheel may have a tread pattern pressed into the sponge rubber during molding. The tread pattern may include a chevron or modified chevron indentations. In one embodiment a segmented chevron pattern is used for the tire treads. The depth and shape of the indentation may allow for improved traction on wet floors while still allowing the robotic cleaning apparatus to move across carpet or other household flooring materials. In particular, the choice of tread pattern may allow the robotic cleaning apparatus to operate while more effectively using a cleaning pad that increases drag on the robotic cleaning apparatus. In some embodiments, the material used may be determined based, at least in part, on the mass of the robotic cleaning apparatus when carrying cleaning fluid, and/or any chemicals contained therein and the properties of the cleaning fluid when on the surface (e.g., the floor).

Embodiments of the methods described herein may be implemented using a controller, processor and/or other programmable device. To that end, the methods described herein may be implemented on a tangible, non-transitory computer readable medium having instructions stored thereon that when executed by one or more processors perform the methods. Thus, for example, a controller may include a storage medium to store instructions (in, for example, firmware or software) to perform the operations described herein. The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

It will be appreciated by those skilled in the art that any block diagrams herein represent conceptual views embodying the principles of the disclosure. Similarly, it will be appreciated that any block diagrams, flow charts, flow diagrams, state transition diagrams, pseudocode, and the like represent various processes which may be substantially represented in computer readable medium and so executed by a computer or processor, whether or not such computer or processor is explicitly shown. Software modules, or simply modules which are implied to be software, may be represented herein as any combination of flowchart elements or other elements indicating performance of process steps and/or textual description. Such modules may be executed by hardware that is expressly or implicitly shown.

Further, while the block flow diagrams and flowchart shown herein illustrate various operations, it is to be understood that the operations need not be executed in the illustrated order and not all of the operations depicted in the therein are necessary for other embodiments to function. Indeed, it is fully contemplated herein that in other embodiments, the operations and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

The functions of the various elements shown in the figures, including any functional blocks described as "controller", may be provided through the use of dedicated hardware as well as hardware capable of executing software in association with appropriate software. The functions may be provided by a single dedicated processor, by a single shared processor, or by a plurality of individual processors, some of which may be shared. Moreover, explicit use of the term "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

The term "coupled" as used herein refers to any connection, coupling, link or the like by which signals carried by one system element are imparted to the "coupled" element. Such "coupled" devices, or signals and devices, may be, but are not necessarily directly connected to one another and may be separated by intermediate components or devices that may manipulate or modify such signals. Likewise, the terms "connected" or "coupled" as used herein in regard to mechanical or physical connections or couplings is a relative term and may include, but does not require, a direct physical connection.

Elements, components, modules, and/or parts thereof that are described and/or otherwise portrayed through the figures to communicate with, be associated with, and/or be based on, something else, may be understood to so communicate, be associated with, and/or be based on in a direct and/or indirect manner, unless otherwise stipulated herein.

Unless otherwise stated, use of the word "substantially" or "approximately" may be construed to include a precise relationship, condition, arrangement, orientation, and/or other characteristic, and deviations thereof as understood by one of ordinary skill in the art, to the extent that such deviations do not materially affect the disclosed methods and systems. Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention.

What is claimed is:

1. A liquid-permeable brush roll comprising:
- a main body having a radial surface;
- a cavity having an open end, the cavity extending within the main body and being configured to store a cleaning fluid therein;
- a stopper removably coupled to the main body at the open end of the cavity;
- one or more weep holes defined in the radial surface of the main body and fluidly coupled to the cavity; and
- a multi-layer outer sheath configured to slidably engage the radial surface of the main body, the multi-layer outer sheath including:
  - a face layer that includes a hydrophobic material;
  - an airlaid first absorbent layer having a first airlaid density; and
  - an airlaid second absorbent layer having a second airlaid density, the second airlaid density being higher than the first airlaid density, the airlaid first absorbent layer being disposed between the face layer and the airlaid second absorbent layer.

2. The liquid-permeable brush roll of claim 1, wherein the multi-layer outer sheath is removably coupled to the main body.

3. The liquid-permeable brush roll of claim 1, wherein the stopper includes an attachment mechanism configured to engage with a drive mechanism that is configured to cause the liquid-permeable brush roll to rotate.

4. A cleaner comprising:
- a chassis; and
- a liquid-permeable brush roll rotatable relative to the chassis, the liquid-permeable brush roll including:
  - a main body having a radial surface;
  - a cavity having an open end, the cavity extending within the main body and being configured to store a cleaning fluid therein;

a stopper removably coupled to the main body at the open end of the cavity;

one or more weep holes defined in the radial surface of the main body and fluidly coupled to the cavity; and a multi-layer outer sheath configured to slidably engage the radial surface of the main body, the multi-layer outer sheath including:

a face layer, the face layer including a hydrophobic material;

a first absorbent layer, the first absorbent layer including a first airlaid material having a first airlaid density; and a second absorbent layer, the second absorbent layer including a second airlaid material having a second airlaid density, the second airlaid density being higher than the first airlaid density, the first absorbent layer being disposed between the face layer and the second absorbent layer, the face layer, the first absorbent layer, and the second absorbent layer each being a different layer.

5. The cleaner of claim 4, wherein the liquid-permeable brush roll is removably coupled to the chassis.

6. The cleaner of claim 4 further comprising a dry cleaning agitator.

7. The cleaner of claim 6, wherein one or more of the liquid-permeable brush roll or the dry cleaning agitator are configured to float relative to the chassis.

8. The cleaner of claim 4, wherein the outer sheath is removably coupled to the main body.

9. The cleaner of claim 4 further comprising a drive mechanism configured to cause the liquid-permeable brush roll to rotate.

10. The cleaner of claim 9, wherein the stopper includes an attachment mechanism configured to engage with the drive mechanism.

11. A robotic cleaner comprising:

a chassis;

a plurality of drive wheels configured to be independently driven;

one or more sensors;

a liquid-permeable brush roll rotatable relative to the chassis, the liquid-permeable brush roll including:

a main body having a radial surface;

a cavity having an open end, the cavity extending within the main body and being configured to store a cleaning fluid therein;

a stopper removably coupled to the main body at the open end of the cavity;

one or more weep holes defined in the radial surface of the main body and fluidly coupled to the cavity; and a multi-layer outer sheath configured to slidably engage the radial surface of the main body, the multi-layer outer sheath including:

a face layer that includes a hydrophobic material;

an airlaid first absorbent layer having a first airlaid density; and an airlaid second absorbent layer having a second airlaid density, the second airlaid density being higher than the first airlaid density, the airlaid first absorbent layer being disposed between the face layer and the airlaid second absorbent layer; and a brush roll motor configured to rotate the liquid-permeable brush roll, wherein the brush roll motor is configured to cause the liquid-permeable brush roll to rotate according to a mixing mode, the mixing mode being configured to mix the cleaning fluid within the cavity.

12. The robotic cleaner of claim 11, wherein the liquid-permeable brush roll is removably coupled to the chassis.

13. The robotic cleaner of claim 11 further comprising a dry cleaning agitator.

14. The robotic cleaner of claim 13, wherein one or more of the liquid-permeable brush roll or the dry cleaning agitator are configured to float relative to the chassis.

15. The robotic cleaner of claim 11, wherein the liquid-permeable brush roll further includes an outer sheath configured to slidably engage the radial surface of the main body, the outer sheath including an absorbent material and being removably coupled to the main body.

16. The robotic cleaner of claim 11, wherein the stopper includes an attachment mechanism configured to cooperate with the brush roll motor to rotate the liquid-permeable brush roll.

* * * * *